US008602609B2

(12) United States Patent
Yun et al.

(10) Patent No.: US 8,602,609 B2
(45) Date of Patent: Dec. 10, 2013

(54) OPTICAL SEMICONDUCTOR LIGHTING APPARATUS

(75) Inventors: Kyung Min Yun, Seongnam-si (KR); Min Su Kim, Seongnam-si (KR); Jung Hwa Kim, Seongnam-si (KR); Dong Soo Kim, Seongnam-si (KR); Kyoo Seok Kim, Seongnam-si (KR)

(73) Assignee: Posco LED Company Ltd., Seongnam-si (KR)

( * ) Notice: Subject to any disclaimer, the term of this patent is extended or adjusted under 35 U.S.C. 154(b) by 0 days.

(21) Appl. No.: 13/554,904

(22) Filed: Jul. 20, 2012

(65) Prior Publication Data

US 2013/0088871 A1 Apr. 11, 2013

(30) Foreign Application Priority Data

| | | |
|---|---|---|
| Oct. 11, 2011 | (KR) | 10-2011-0103826 |
| Nov. 10, 2011 | (KR) | 10-2011-0116740 |
| Mar. 16, 2012 | (KR) | 10-2012-0026853 |
| May 23, 2012 | (KR) | 10-2012-0054719 |

(51) Int. Cl.
*F21V 29/02* (2006.01)

(52) U.S. Cl.
USPC ..... 362/373; 362/294

(58) Field of Classification Search
USPC ..... 362/294, 373, 547, 345, 580, 126, 218, 362/264; 361/676, 678, 688, 690, 697; 257/712, 722
See application file for complete search history.

(56) References Cited

U.S. PATENT DOCUMENTS

| | | | | |
|---|---|---|---|---|
| 7,494,248 | B2 * | 2/2009 | Li | 362/294 |
| 8,487,517 | B2 * | 7/2013 | Fang et al. | 362/294 |
| 2009/0196054 | A1 * | 8/2009 | Cheng | 362/373 |
| 2013/0100662 | A1 * | 4/2013 | Lin | 362/235 |

FOREIGN PATENT DOCUMENTS

| | | |
|---|---|---|
| JP | 2003-347601 | 12/2003 |
| JP | 2004-128433 | 4/2004 |
| JP | 2004-207367 | 7/2004 |
| JP | 2005-108544 | 4/2005 |
| JP | 3110731 | 6/2005 |
| JP | 2007-109504 | 4/2007 |
| JP | 3143732 | 7/2008 |
| JP | 2009-245846 | 10/2009 |
| KR | 10-0516123 | 9/2005 |
| KR | 10-2006-0092808 | 8/2006 |
| KR | 10-2008-0058878 | 6/2008 |
| KR | 10-0925048 | 11/2009 |
| KR | 10-2009-0132946 | 12/2009 |
| KR | 10-0945732 | 12/2009 |

(Continued)

OTHER PUBLICATIONS

Japanese Office Action dated Oct. 16, 2012 for JP Patent Application No. 2012-179586.

*Primary Examiner* — Bao Q Truong
(74) *Attorney, Agent, or Firm* — H.C. Park & Associates, PLC

(57) ABSTRACT

An optical semiconductor lighting apparatus includes a heat sink including a heat dissipation base and a plurality of heat dissipation fins formed on a lower surface of the heat dissipation base; an optical semiconductor device placed on the heat dissipation base; and an optical cover coupled to an upper side of the heat sink to cover the optical semiconductor device. The heat dissipation base is formed with an air flow hole through which upper ends of the heat dissipation fins are exposed.

21 Claims, 19 Drawing Sheets

(56) References Cited

FOREIGN PATENT DOCUMENTS

| | | |
|---|---|---|
| KR | 10-2010-0020244 | 2/2010 |
| KR | 10-0940884 | 2/2010 |
| KR | 10-0942309 | 2/2010 |
| KR | 10-2010-0090158 | 8/2010 |
| KR | 10-2010-0114789 | 10/2010 |
| KR | 10-2011-0009550 | 1/2011 |
| KR | 10-2011-0061927 | 6/2011 |
| KR | 10-2011-0062822 | 6/2011 |
| KR | 10-2012-0049576 | 5/2012 |
| WO | 2007-126074 | 11/2007 |
| WO | 2009-110683 | 9/2009 |

* cited by examiner

OPTICAL SEMICONDUCTOR LIGHTING APPARATUS

CROSS REFERENCE TO RELATED APPLICATIONS

This application claims priority from and the benefit of Korean Patent Application No. 10-2011-0103826, filed on Oct. 11, 2011; No. 10-2011-0116740, filed on Nov. 10, 2011; No. 10-2012-0026853, filed on Mar. 16, 2012; and No. 10-2012-0054719, filed on May 23, 2012, all of which are hereby incorporated by reference for all purposes as if fully set forth herein.

BACKGROUND

1. Technical Field

The present invention relates to an optical semiconductor lighting apparatus.

2. Description of the Related Art

Optical semiconductor devices such as light emitting diodes (LEDs) have is attracted increasing attention due to excellent advantages such as low power consumption, long lifespan, high durability, and excellent brightness, as compared with incandescent lamps or fluorescent lamps.

In particular, an optical semiconductor device is free from toxic or environmentally unfriendly substances such as mercury injected into a glass tube together with argon gas in manufacture of fluorescent lamps or mercury lamps, thereby providing environmentally friendly products.

In recent years, a lighting apparatus using an optical semiconductor device has been actively developed and studied in terms of light engines.

Particularly, as a lighting apparatus including an optical semiconductor device as a light source has been applied to outdoor lighting or security lighting, such a lighting apparatus needs to provide convenience in assembly and installation and to maintain waterproof performance even under outdoor conditions for a long period of time.

A conventional light emitting module needs to provide wide and uniform illumination using as few optical semiconductor devices as possible.

Accordingly, a conventional lighting apparatus employs lenses for spreading light emitted from the optical semiconductor devices.

In the conventional lighting apparatus, however, a relatively dark area can be generated between the lenses.

In addition, light emitted from the optical semiconductor device can be absorbed by protrusions on a heat sink before passing through an optical cover.

Meanwhile, it can be conceivable to provide a lighting apparatus in which at least one light emitting module including a heat sink is coupled to a housing.

In the light emitting module, the heat sink is provided at a rear side thereof with heat dissipation fins and at a front side thereof with a printed circuit board (PCB), on which optical semiconductor devices are mounted and respectively covered by lenses.

Here, the optical cover is assembled to the front side of the heat sink to cover the PCB, the optical semiconductor devices, and the lenses.

To fabricate such a conventional light emitting module, the lenses need to be placed corresponding to the optical semiconductor devices.

In addition, light emitted from the optical semiconductor devices passes through the optical cover after passing through the lenses, and is thus subjected to optical loss.

Further, moisture or other foreign matter is likely to enter the light emitting module through a gap between the optical cover and the heat sink.

Meanwhile, the lighting apparatus may include a plurality of light emitting modules as described above.

In this case, the lighting apparatus needs a complicated wire connection structure to supply power from a power source to the light emitting modules through a main power wire.

At this time, such a complicated wire connection structure increases manufacturing costs while reducing operation efficiency.

For the conventional lighting apparatus, since individual light emitting modules are connected to one another via the complicated wire connection structure, it is difficult to separate the individual light emitting modules from one another, thereby providing difficulty in replacement, repair and maintenance of the light emitting modules.

On the other hand, a conventional light engine is generally provided with a heat sink above a light emitting module, which includes an optical semiconductor device such as an LED, and thus has difficulty in natural convection cooling.

Currently, a light engine for outdoor products using optical semiconductor devices does not have such cooling performance.

BRIEF SUMMARY

The present invention has been conceived to solve such problems in the related art, and an aspect of the present invention is to provide an optical semiconductor lighting apparatus, which can provide convenience in overhaul and repair, facilitate assembly and disassembly, and ensure excellent waterproof performance and durability.

Another aspect of the present invention is to provide a light emitting module, which can minimize optical loss or occurrence of dark areas and can provide wide and uniform illumination through an optical cover including lenses integrated therewith.

A further aspect of the present invention is to provide a light emitting module, which can minimize optical loss due to absorption of light by protrusions on a heat sink for ensuring water-tightness when the light is emitted from an optical semiconductor device and an optical semiconductor chip.

Yet another aspect of the present invention is to provide a light emitting module, which has further improved heat dissipation characteristics through an air flow passage formed through a lower side of the heat sink to an upper side thereof.

Yet another aspect of the present invention is to provide an optical semiconductor lighting apparatus, which has a reliable connection structure for easy electrical connection between light emitting modules of the lighting apparatus.

Yet another aspect of the present invention is to provide an optical semiconductor lighting apparatus, which has a large heat dissipation area to improve heat dissipation and cooling efficiency by natural convection.

In accordance with an aspect, the present invention provides an optical semiconductor lighting apparatus, which includes: a heat sink including a heat dissipation base and a plurality of heat dissipation fins formed on a lower surface of the heat dissipation base; an is optical semiconductor device placed on the heat dissipation base; and an optical cover coupled to an upper side of the heat sink to cover the optical semiconductor device. Here, the heat dissipation base is formed with an air flow hole through which upper ends of the heat dissipation fins are exposed.

The optical cover may be formed with an opening through which the air flow hole and the heat dissipation fins are exposed.

Here, the heat dissipation base may include a printed circuit board mounting region around the air flow hole. The printed circuit board includes a plurality of optical semiconductor devices mounted thereon.

The heat dissipation fins may be integrally formed with upward extending portions which extend above an upper surface of the heat dissipation base through the air flow hole.

The heat dissipation base may include a partition wall protruding along a circumference of the air flow hole.

The heat dissipation base may include a partition wall protruding along a circumference of the air flow hole to be inserted into the opening of the optical cover.

Each of the heat dissipation fins may be integrally formed with an upward extending portion which extends above an upper surface of the heat dissipation base through the is air flow hole and is connected at both sides thereof with a partition wall protruding along a circumference of the air flow hole.

The optical cover may include an inner wall formed along a circumference of the opening and extending downwards to be inserted into an upper portion of the air flow hole.

The optical cover may include a lens portion corresponding to the optical semiconductor device.

The heat dissipation base may include male and female connectors placed on opposite sides thereof, respectively, and at least one of the male and female connectors may be connected to a female or male connector of another heat dissipation base adjacent to the heat dissipation base.

The heat dissipation base may have a width and a length, the air flow hole may be longitudinally formed in an elongated shape at the middle of the heat dissipation base, the heat dissipation base may be provided on an upper surface thereof with a pair of longitudinally elongated regions, with the air flow hole interposed therebetween, and the printed circuit board including the plurality of optical semiconductor devices may be mounted on the longitudinally elongated regions.

The heat dissipation fins and the upward extending portions may divide the air flow hole into a plurality of cell-type holes.

In accordance with another aspect, the present invention provides an optical semiconductor lighting apparatus, which includes: a heat sink including a heat dissipation base; at least one circuit board mounted on the heat dissipation base; a plurality of optical semiconductor devices mounted on the circuit board; and an optical cover disposed to cover the optical semiconductor devices. Here, the heat dissipation base is formed with an air flow hole.

The optical cover may include an opening corresponding to the air flow hole.

The heat dissipation base may include a partition wall protruding along a circumference of the air flow hole.

The partition wall may be inserted into the opening of the optical cover.

The optical cover may include an inner wall formed along a circumference of the opening and extending downwards to be inserted into an upper portion of the air flow hole.

In accordance with a further aspect, the present invention provides an optical semiconductor lighting apparatus, which includes: a first light emitting module; and a second light emitting module disposed adjacent the first light emitting module, wherein the first light emitting module is provided at one side thereof with a female connector and the second light emitting module is provided, at the other side thereof facing the one side of the first light emitting module, with a male connector inserted into and connected to the female connector.

In accordance with yet another aspect, the present invention provides an optical is semiconductor lighting apparatus, which includes: a light emitting module including at least one optical semiconductor device; a heat sink including a plurality of heat dissipation fins formed on the light emitting module; and an air flow passage formed in a space between adjacent heat dissipation fins.

The heat sink may include a heat dissipation base coupled to the light emitting module and a plurality of heat dissipation fins extending from the heat dissipation base.

The heat sink may include an air flow passage formed in a space between adjacent heat dissipation fins and the heat dissipation base.

The heat sink may include a plurality of heat dissipation fins disposed in a longitudinal direction of the light emitting module, and a heat sink base disposed at one side of the heat sink to connect one side of each of the heat dissipation fins to one side of another heat dissipation fin and having the light emitting module mounted thereon.

The optical semiconductor lighting apparatus may further include a service unit disposed on at least one side of the heat sink and electrically connected to the light emitting module.

The heat sink may further include a lip extending from one side of the heat dissipation base and separated from a connecting portion between the heat dissipation base and the heat dissipation fins, and an air slot formed in a longitudinal direction of the lip.

The heat sink may have a slanted edge facing edges of the heat dissipation fins on which the heat dissipation base is disposed, and being slanted from one side to the other side, and the heat dissipation base may be placed to adjoin one side of each of the heat dissipation fins.

The heat sink may further include a reinforcing rib extending from an edge facing edges of the heat dissipation fins connected to the heat dissipation base to connect all of the heat dissipation fins to each other.

The air flow passage may include an inlet formed near one side of the heat dissipation base at the one side of each of the heat dissipation fins, and an outlet formed at one end of an edge facing edges of the heat dissipation fins on which the heat dissipation base is disposed.

The heat sink may further include an air baffle covering the plurality of heat dissipation fins from the slanted edge facing the edges of the heat dissipation fins on which the heat dissipation base is disposed, to an edge extending from the slanted edge.

The service unit may include a unit body formed on either side of the heat sink and a connector formed on the unit body.

The service unit may include a unit body formed on either side of the heat sink and a driving printed circuit board formed on the unit body.

The service unit may include a unit body formed on either side of the heat sink and a charge/discharge device formed on the unit body.

As used herein, the term 'optical semiconductor device' refers to a light emitting diode chip which includes or uses an optical semiconductor.

Such an 'optical semiconductor device' may also refer to a package including various kinds of optical semiconductors therein, as well as the light emitting diode chip.

With the structure as described above, the present invention may provide the following advantageous effects.

First, the lighting apparatus includes a housing, which can be divided into a plurality of detachable components and surrounds a light emitting module including an optical semiconductor device, thereby enabling convenient assembly and disassembly of the lighting apparatus while improving durability.

In addition, the respective components of the housing may be separated from each other, whereby an operator can conveniently overhaul and repair the lighting apparatus when the lighting apparatus fails.

Further, the lighting apparatus includes a sealing member between the optical cover and a heat sink, thereby providing a waterproof and air-tight structure.

Further, the optical cover, the optical semiconductor device, and the printed circuit board are integrated to an improved structure via a heat dissipation member and/or the is housing so as to be disposed in a reliable and compact structure in a certain area of the lighting apparatus.

Further, when the lighting apparatus includes the light emitting module, the optical cover of the light emitting module is integrally formed with lenses, thereby minimizing optical loss or generation of dark areas while providing wide and uniform illumination.

Further, the lighting apparatus may minimize optical loss due to absorption of light by protrusions formed on the heat sink when the light is emitted from the optical semiconductor device, specifically, from the light emitting diode chip.

Further, a gap between the heat sink of the light emitting module and the optical cover is sealed, thereby significantly reducing failure of the lighting apparatus by infiltration of moisture or other foreign matter.

Further, the heat dissipation base of the heat sink, on which the optical semiconductor device is disposed, is formed with an air flow hole, thereby improving heat dissipation characteristics of a specific region in the heat sink, particularly, a central region of the heat dissipation base, while preventing damage of the optical semiconductor device caused by heat accumulation.

Particularly, as the optical cover is placed on the heat sink to cover the optical semiconductor device, the air flow hole and the heat dissipation fins are exposed through the is opening of the optical cover, thereby further improving heat dissipation.

Further, when plural light emitting modules are provided to a single lighting apparatus, each of the light emitting modules is provided at opposite sides thereof with female and male connectors facing a male or female connector of another light emitting module adjacent thereto, facilitating reliable electrical connection between the light emitting modules while improving operation efficiency by eliminating a complicated process for wire connection between the light emitting modules.

In particular, when there is a problem with one of the light emitting modules, the lighting apparatus allows easy replacement or repair of the light emitting module.

Conventionally, when the plural light emitting modules are provided to a single lighting apparatus, the light emitting modules are sufficiently separated from each other to prevent failure caused by heat from the light emitting modules. According to the present invention, however, the respective light emitting modules have improved heat dissipation performance by the air flow hole, thereby preventing a problem caused by heat when the light emitting modules are disposed adjacent each other via the male and female connectors.

As such, the air flow hole improves heat dissipation of the light emitting modules, thereby enabling reduction of a distance between the light emitting modules.

In addition, the heat sink is formed with an air flow passage of various shapes in is a longitudinal direction of the light emitting module, thereby improving heat dissipation efficiency through increase in a heat transfer area while inducing natural conduction to improve cooling efficiency.

Furthermore, the heat sink is provided at opposite sides thereof with service units, which may be modified according to installation place and conditions to provide various driving mechanisms.

BRIEF DESCRIPTION OF THE DRAWINGS

The above and other aspects, features and advantages of the present invention will become apparent from the following description of embodiments given in conjunction with the accompanying drawings, in which.

DETAILED DESCRIPTION

Next, embodiments of the present invention will be described in detail with reference to the accompanying drawings.

Figure 1:
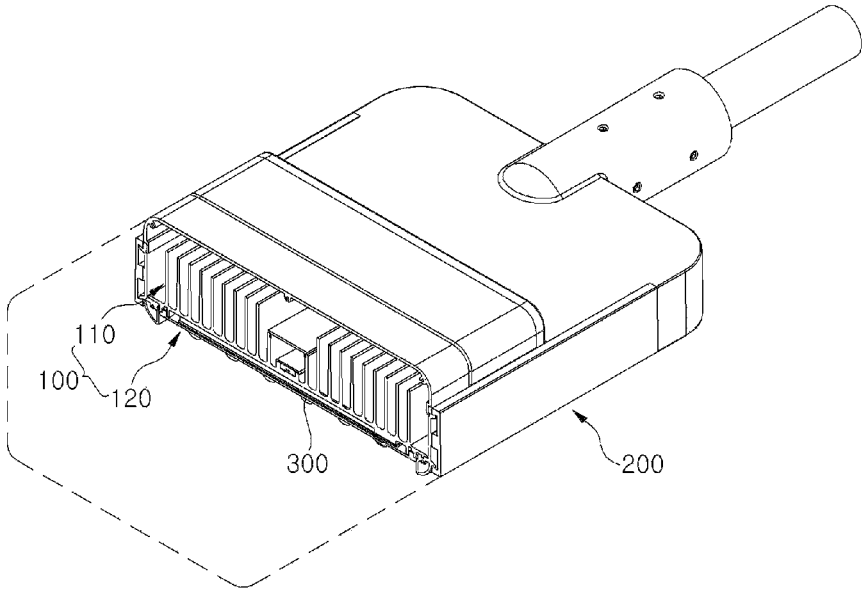
FIG. 1 is a partially cut-away perspective view of an optical semiconductor lighting apparatus in accordance with one embodiment of the present invention.
Figure 2:
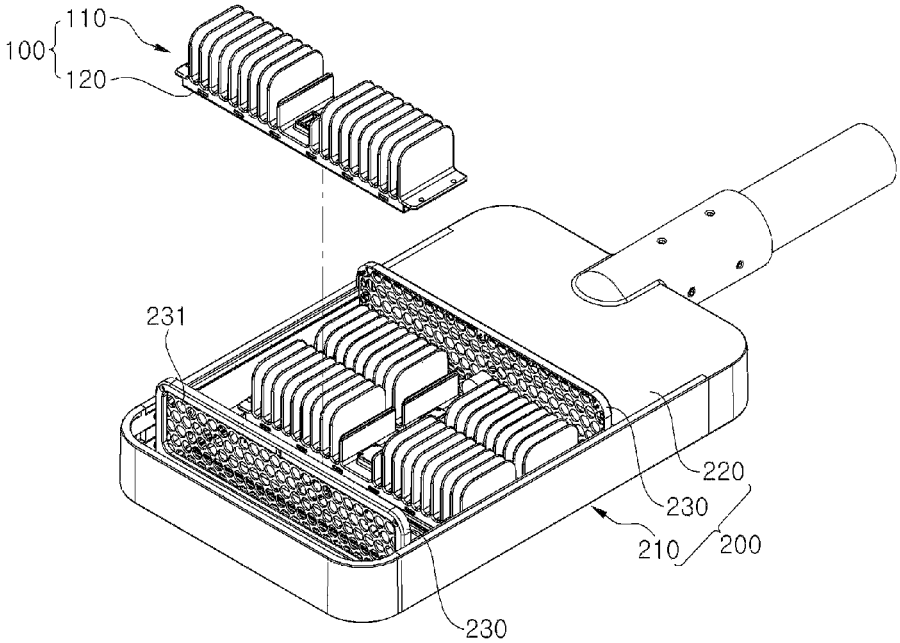
FIG. 2 is an exploded perspective view of the optical semiconductor lighting apparatus in accordance with the embodiment of the present invention, in which a light emitting module is separated from a housing of the lighting apparatus.

FIG. 1 is a partially cut-away perspective view of an optical semiconductor lighting apparatus in accordance with one embodiment of the present invention, and FIG. 2 is an exploded perspective view of the optical semiconductor lighting apparatus in accordance with the embodiment of the present invention, in which a light emitting module is separated from a housing of the lighting apparatus.

As shown in the drawings, the lighting apparatus according to this embodiment includes a housing 200 which receives a light emitting module 100 therein. The light emitting module 100 includes a heat sink 110, which includes optical semiconductor devices 150 disposed thereon, and an optical cover 120 coupled to the heat sink 110.

In FIG. 1, reference numeral 140 denotes a printed circuit board.

Referring to FIG. 2, the housing 200 includes a support frame 220, side frames 210 respectively coupled to opposite sides of the support frame 220, and securing plates 230 disposed inside the side frames 210 such that at least one light emitting module 100 is placed between the securing plates 230.

In addition to the embodiment described above, the present invention may be realized by various embodiments.

Figure 3:
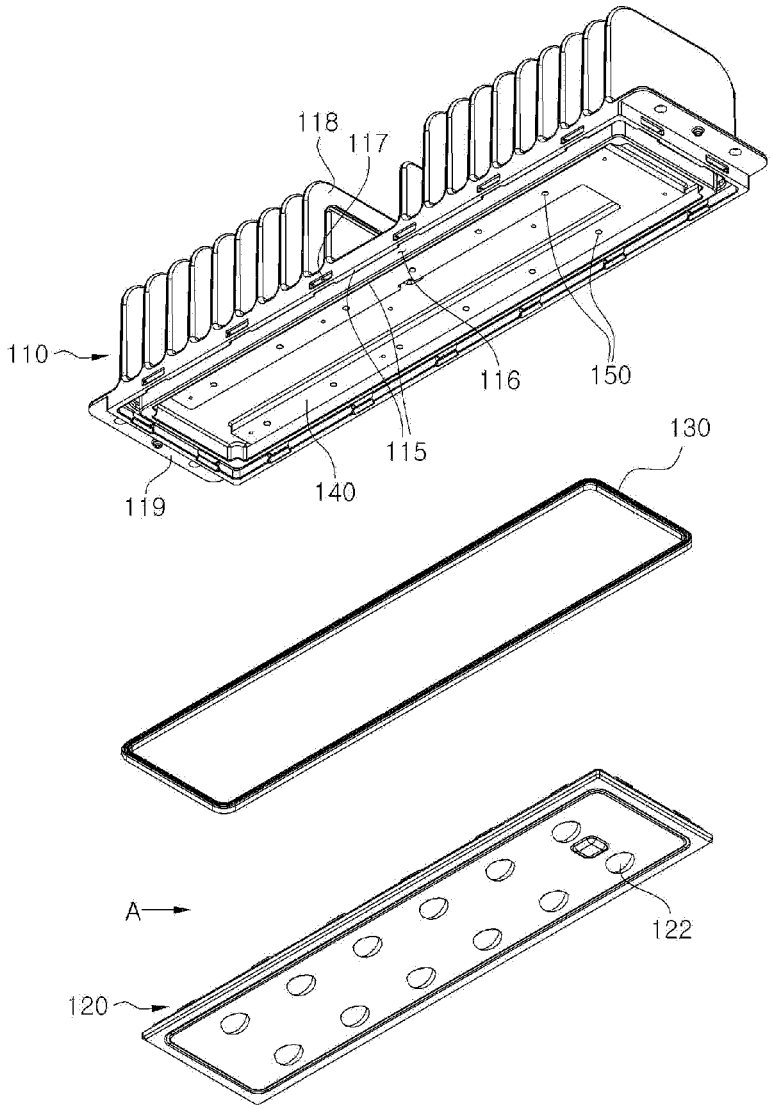
FIG. 3 is an exploded perspective view of the light emitting module as a main part of the optical semiconductor lighting apparatus in accordance with the embodiment of the is present invention.
Figure 4:
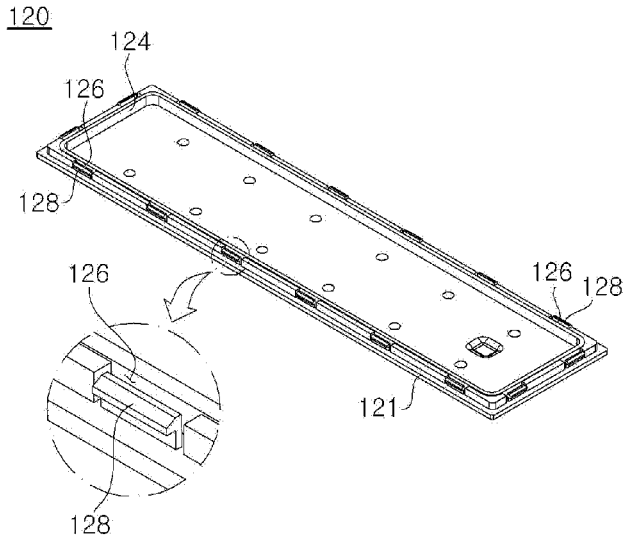
FIG. 4 is a perspective view of an optical cover of the light emitting module in the optical semiconductor lighting apparatus in accordance with the embodiment of the present invention.
Figure 5:
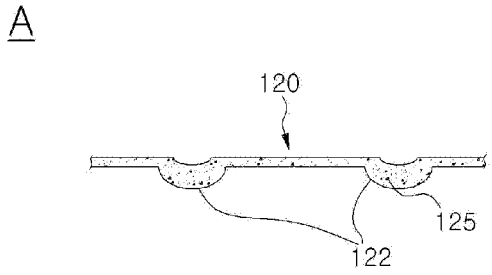
FIG. 5 to FIG. 7 are partially sectional view of an optical plate in accordance with various embodiments of the present invention.
Figure 6:
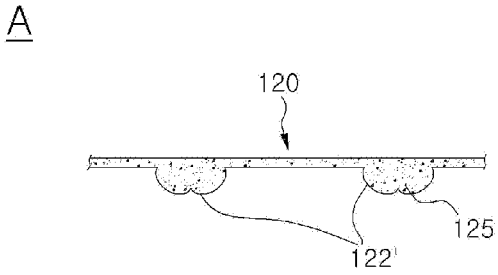
Figure 7:
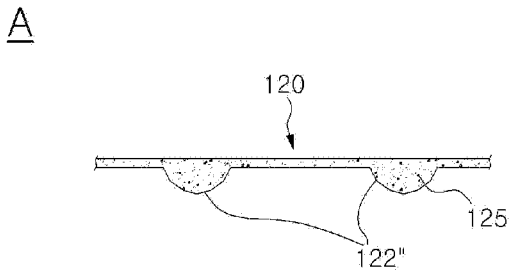

FIG. 3 is an exploded perspective view of the light emitting module as a main part of the optical semiconductor lighting apparatus in accordance with the embodiment of the present invention, FIG. 4 is a perspective view of an optical cover of the light emitting module in the optical semiconductor lighting apparatus in accordance with the embodiment of the present invention, and FIG. 5 to FIG. 7 are partial sectional views of an optical plate in accordance with various embodiments of the present invention.

As described above, the light emitting module 100 includes the optical semiconductor devices 150 and has a structure wherein the optical cover 120 is coupled to the heat sink 110.

The heat sink 110 has the optical semiconductor devices 150 mounted thereon and is provided to an inner lower side of the housing 200 to discharge heat from the optical semiconductor devices 150, and the optical cover 120 is secured to the heat sink 110 along an edge of the heat sink 110 to protect the optical semiconductor devices 150 while providing a function of spreading light.

As shown in the drawings, the housing 200 receives at least one light emitting module 100 placed between the securing plates 230 inside the side frames 210 coupled to is opposite sides of the support frame 220.

Each of the side frames 210 surrounds the light emitting module 100, the support frame 220 is coupled to the side frames 210 to be connected to an external power source, and the securing plates 230 are placed inside the side frames 210 to hold both sides of the light emitting module 100.

Here, each of the securing plates 230 may be formed with a plurality of holes 231 to further improve heat dissipation efficiency of the housing by increasing a heat transfer area as much as possible.

Next, the heat sink 110 of the light emitting module 100 will be described in detail with reference to FIGS. 3 and 4. Referring to FIGS. 3 and 4, the heat sink 110 includes a heat dissipation base 119, which is formed with a groove 116, fastening slits 117, and heat dissipation fins 118. An edge of the optical cover 120 is inserted into the groove of the heat dissipation base 119, and hooks 128 formed along the edge of the optical cover 120 described below are latched to the fastening slits 117.

The heat dissipation base 119 provides a region on which the optical semiconductor devices 150 are placed, and the optical semiconductor devices 150 are electrically connected to an external power source via the support frame 220.

The heat dissipation fins 118 protrude from the heat dissipation base 119 to is increase a heat transfer area, thereby improving heat dissipation efficiency.

As shown in the drawings, the heat dissipation fins 118 may be formed by arranging simple flat members at constant intervals on the heat dissipation base 119. Various modifications of the heat dissipation fins 118 will be apparent to a person having ordinary knowledge in the art, and additional descriptions thereof will thus be omitted herein.

The groove 116 is a portion on which the edge of the optical cover 120 is seated in a longitudinal direction of a latch jaw 115, which protrudes from the heat dissipation base 119 in a shape corresponding to the edge of the optical cover 120.

The fastening slits 117 are arranged at constant intervals outside the latch jaw 115 to catch and secure the edge of the optical cover 120.

Meanwhile, the optical cover 120 includes a light-transmitting cover plate 121, which includes an edge section 124 seated on the heat sink 110, cut-away sections 126 formed along the edge section 124, and hooks 128 protruding from the cut-away sections 126 to be caught and secured by the fastening slits 117.

The light-transmitting cover plate 121 is provided with a lens section 122 corresponding to the optical semiconductor device 150 and serves to protect the optical semiconductor device 150 while increasing an illumination area capable of receiving light emitted from the optical semiconductor device 150.

The edge section 124 protrudes from the light-transmitting cover plate 121 in a shape corresponding to the edge of the heat sink 110 and is seated on the groove 116 of the heat sink 110 to allow the optical cover 120 to secure the heat sink 110.

The cut-away sections 126 are arranged at constant intervals along the edge section 124 to a depth of the light-transmitting cover plate 121 and provide spaces in which the hooks 128 will be formed.

The hooks 128 protrude from the light-transmitting cover plate 121 to be located on the cut-away sections 126, and are detachably coupled to the plural fastening slits 117 formed along the edge of the heat sink 110.

Here, the installation places and number of hooks 128 and fastening slits 117 may be changed according to application conditions of the optical semiconductor lighting apparatus. For example, when a total of 12 hooks 128 are longitudinally arranged at regular intervals of 45 mm along the light-transmitting cover plate 121 to have 6 hooks 128 disposed at either side of the light-transmitting cover plate 121, it is possible to satisfy requirements for the anti-dust and waterproof grade (preferably, a grade of IP65 or more) of outdoor security lamps or street lamps.

Further, the heat sink 110 is provided with a sealing member 130 between the groove 116 and the optical cover 120 to maintain air-tightness and waterproof performance.

In some embodiments, to improve brightness of the optical cover 120 and is increase an illumination area, an optical diffusion paint (not shown) or an optical diffusion film (not shown) may be applied to a surface of the light-transmitting cover plate 121. In other embodiments, the light-transmitting cover plate 121 may be formed of a transparent or translucent synthetic resin mixed with an optical diffusion material 125.

Here, the optical diffusion paint may contain organic particles such as PMMA or silicone beads.

Further, although not shown in detail, the optical cover 120 may further include a colored plate between the optical semiconductor device 150 and the light-transmitting cover plate 121 to achieve diffuse reflection of light emitted from the optical semiconductor device 150.

Meanwhile, the lens section 122 may be constituted by a convex or concave lens (not shown) to obtain optical diffusion, as shown in FIG. 5.

The lens section may be realized in various ways. For example, the optical cover 120 may have a lens section 122', which includes at least two elliptical spheres overlapping each other to be inclined with respect to the light-transmitting cover plate 121 in order to improve optical diffusion, as shown in FIG. 6. Alternatively, the optical cover 120 may have a lens section 122", which has a polyhedral shape as shown in FIG. 7.

Figure 8:
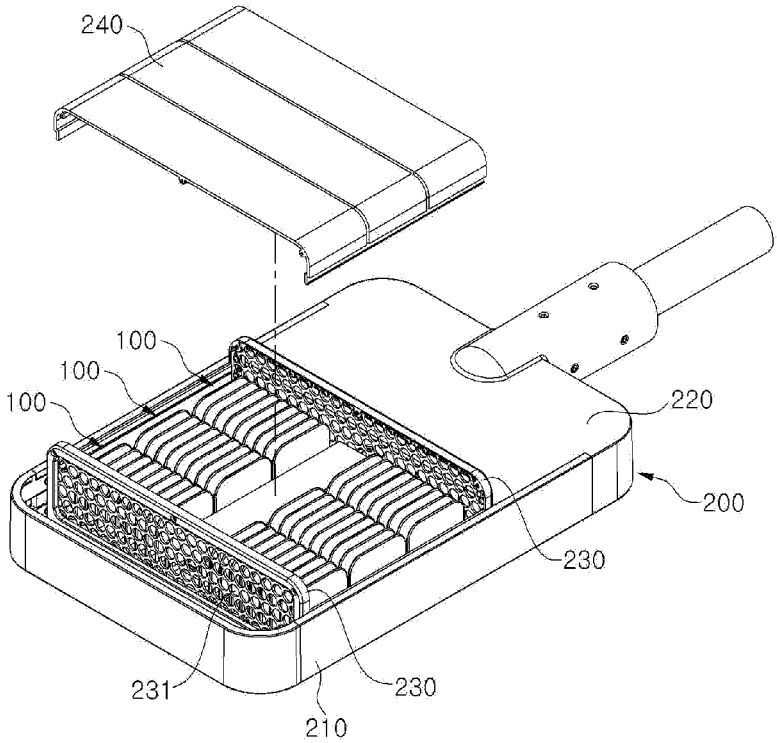
FIG. 8 and FIG. 9 are perspective views illustrating a process of dissembling the optical semiconductor lighting apparatus in accordance with the embodiment of the present invention.
Figure 9:
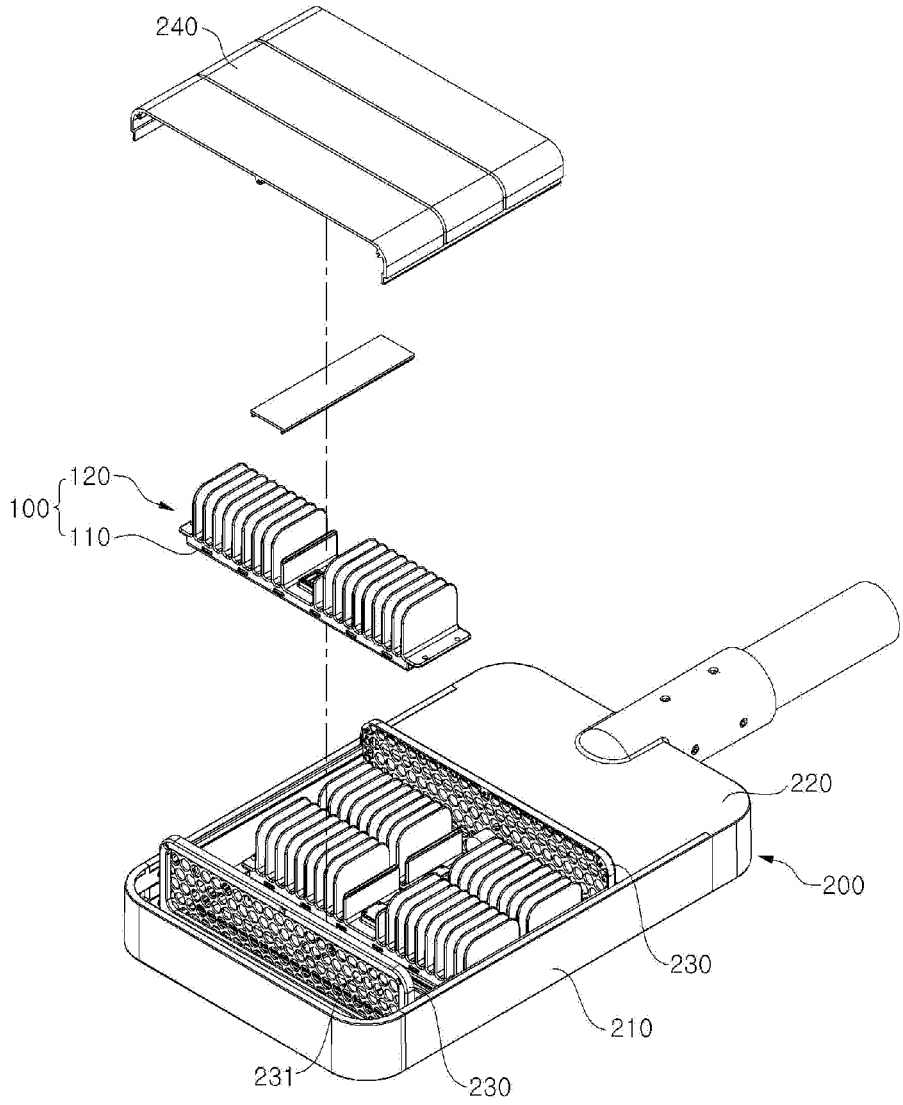
Figure 10:
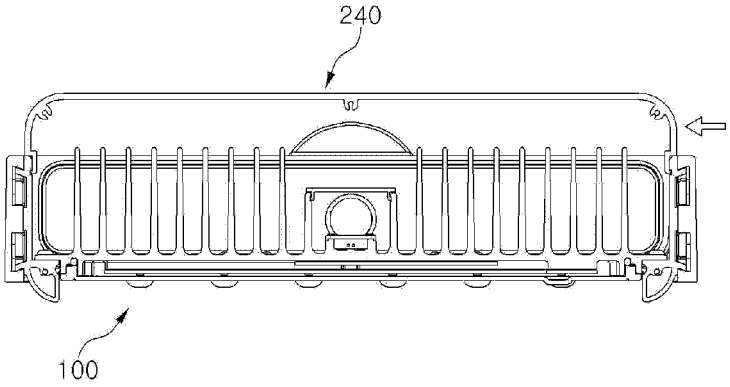
FIG. 10 and FIG. 11 are views illustrating a process of separating a cover from the optical semiconductor lighting apparatus in accordance with the embodiment of the present invention.
Figure 11:
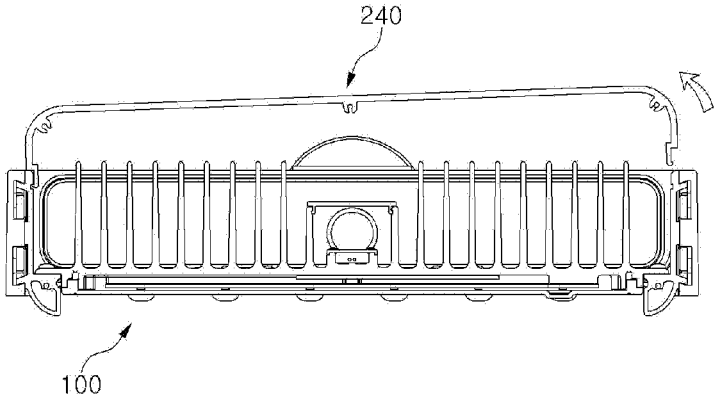

FIGS. 8 and 9 are perspective views of a process of disassembling the optical is semiconductor lighting apparatus in accordance with the embodiment, and FIGS. 10 and 11 are views illustrating a process of separating a cover from the optical semiconductor lighting apparatus in accordance with the embodiment.

Referring to FIGS. 8 and 9, the lighting apparatus includes a housing 200 and a plurality of light emitting modules 100 mounted on the housing 200.

The housing 200 includes a box-shaped support frame 220 and side frames 210 coupled to opposite sides of the support frame 220.

The side frames 210 define a space closed at a front side thereof and open at upper and lower portions thereof in cooperation with the support frame 220.

By the connection structure of the side frames 210 and the support frame 220, the housing 200 has a structure that is open at upper and lower portions thereof and surrounds the light emitting modules 100.

In the lighting apparatus, the housing 200 is open in a vertical direction of the light emitting module 100 such that the light emitting modules 100 can be mounted or detached from the housing 200 in the vertical direction.

With this structure of the lighting apparatus, when a certain light emitting module 100 is not operated or in an abnormal state, an operator can easily remove this light emitting module 100 from the housing in the vertical direction after separating only the cover 240.

In operation of separating the light emitting module 100 from the housing 200, the light emitting module 100 can be easily separated from the housing 200 by vertically lifting the light emitting module 100 from a position between securing plates 230 facing each other within the housing 200 after separating the cover 240 from the housing 200. Here, the cover 240 is detachably attached to the upper portion of the housing 200.

On the contrary, a repaired or substituted light emitting module 100 can be easily mounted on the housing 200 by vertically inserting the light emitting module 100 into the housing 200.

Accordingly, there is no need for disassembly of the overall components of the housing 200 in the case of mounting or detaching the light emitting module 100 from the housing after installation of the lighting apparatus.

The housing 200 is configured to enclose an array of light emitting modules 100.

In the housing 200, a pair of securing plates 230 is disposed at front and rear sections in the space defined by a front side of the box-shaped support frame 220 and the side frames 210 coupled to the opposite sides of the support frame 220 to traverse the space.

The plurality of light emitting modules 100 is arranged parallel to each other between the securing plates 230.

In this structure, the side frames 210 act as walls surrounding the light emitting is modules 100.

The side frames 210 may be slidably coupled to the support frame 220.

The support frame 220 has a box shape partially closed by the securing plate 230 placed at the rear section, and cables connected to an external power source is connected to the light emitting modules 100 through the support frame 220 and the securing plates 230, as shown in the drawings.

Each of the securing plates 230 is formed with a plurality of holes 231, thereby allowing rapid discharge of heat from the housing 200.

When separating the cover 240 from the housing, an operator applies force in an arrow direction as shown in FIG. 10, so that the cover 240 can be easily separated above the light emitting modules 100, as shown in FIG. 11.

Of course, although not shown in the drawings, an operator may separate the cover 240 from the housing 200 above the light emitting modules 100 by applying force to both sides of the cover 240.

The overall structure of the housing on which the light emitting modules are mounted has been described above.

Next, the light emitting module will be described in more detail.

Although the light emitting module described below is well suited to the lighting is apparatus having the housing of the structure described above, it should be understood that the light emitting module may also be applied to other types of lighting apparatus.

Figure 12:
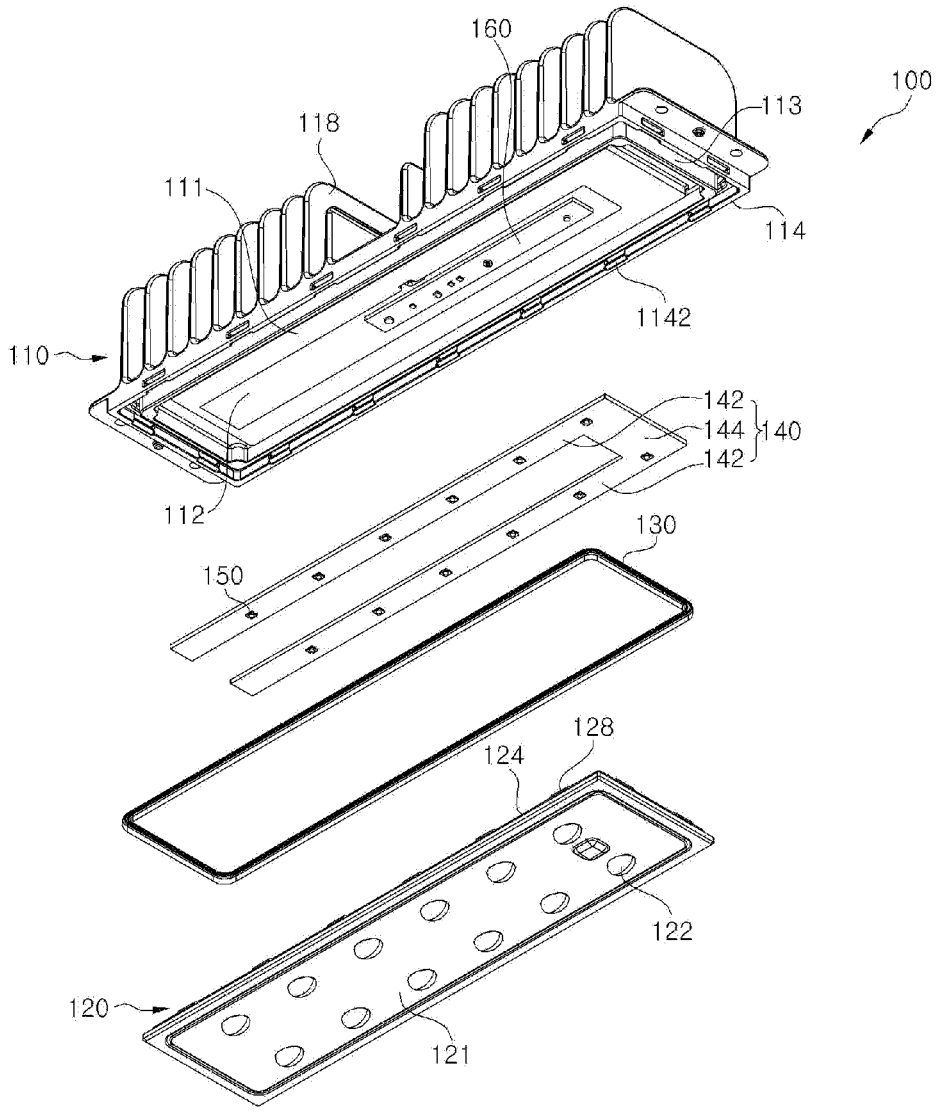
FIG. 12 is an exploded perspective view of a light emitting module in accordance with one embodiment of the present invention.
Figure 13:
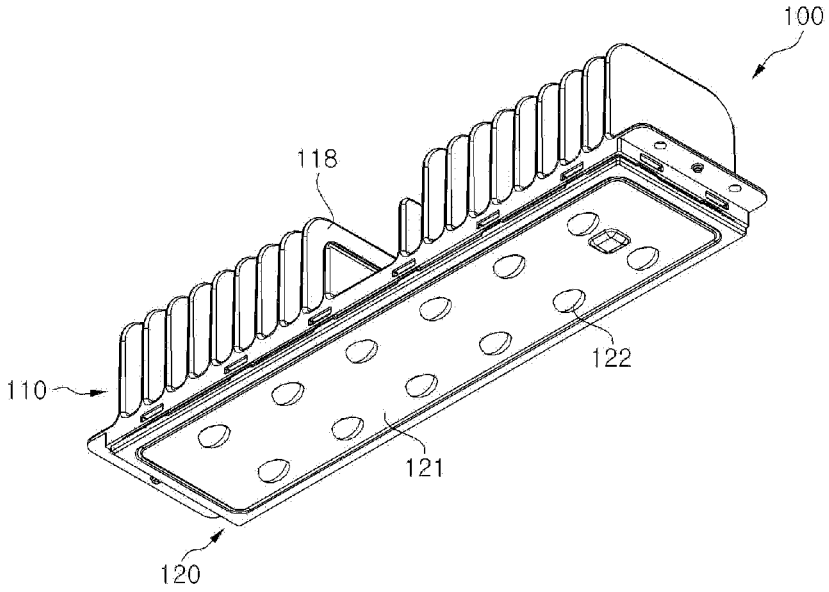
FIG. 13 is a perspective view of the light emitting module in accordance with the embodiment of the present invention.
Figure 14:
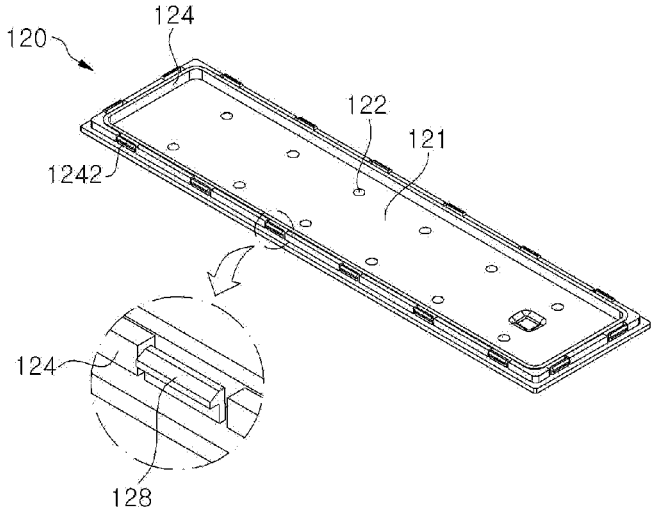
FIG. 14 is a perspective view of an optical cover shown in FIGS. 12 and 13.
Figure 15:
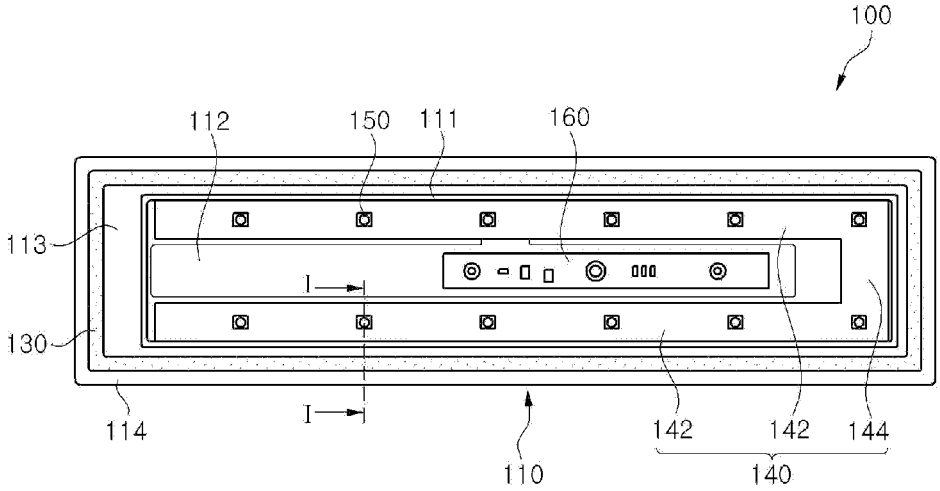
FIG. 15 is a front view of the light emitting module shown in FIGS. 12 and 13, in which the optical cover is omitted from the light emitting module.
Figure 16:
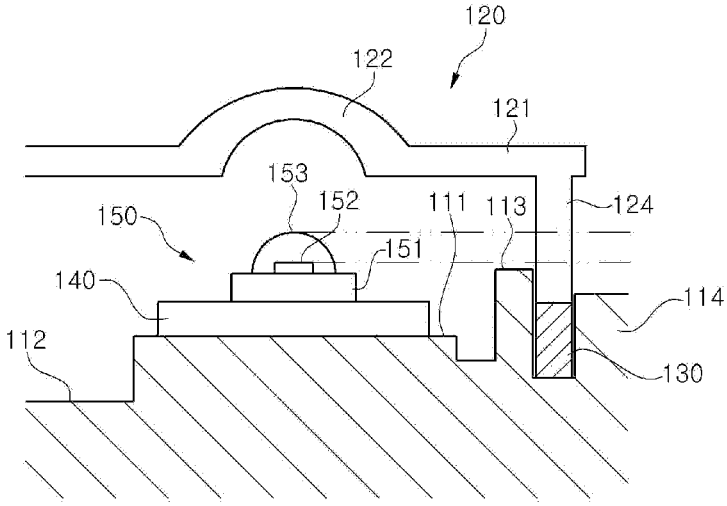
FIG. 16 is a cross-sectional view of the light emitting module taken along line I-I of FIG. 15, with the optical cover coupled thereto.
Figure 17:
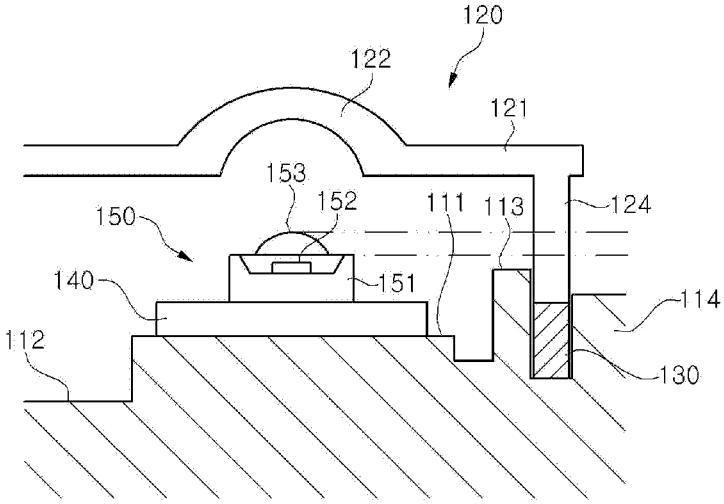
FIG. 17 is a cross-sectional view of a light emitting module which has the same structure as the light emitting module shown in FIG. 16 but includes a different type of optical semiconductor device.

FIG. 12 is an exploded perspective view of a light emitting module in accordance with one embodiment of the present invention; FIG. 13 is a perspective view of the light emitting module in accordance with the embodiment; FIG. 14 is a perspective view of an optical cover shown in FIGS. 12 and 13; FIG. 15 is a front view of the light emitting module shown in FIGS. 12 and 13, in which the optical cover is omitted from the light emitting module; FIG. 16 is a cross-sectional view of the light emitting module taken along line I-I of FIG. 15, with the optical cover coupled thereto; and FIG. 17 is a cross-sectional view of a light emitting module which has the same structure as the light emitting module of FIG. 16 but includes a different type of optical semiconductor device.

Referring to FIGS. 12 to 17, the light emitting module 100 according to this embodiment includes a heat sink 110 acting as a heat dissipation member, an optical cover 120 coupled to an upper side of the heat sink 110, a printed circuit board 140 mounted on an upper surface of the heat sink 110 to be interposed between the heat sink 110 and the optical cover 120, and a plurality of optical semiconductor devices 150 mounted on the printed circuit board 140.

In this embodiment, the heat sink 110 is open at the upper side thereof and has an edge extending from the upper surface thereof on which the printed circuit board 140 is placed, and the optical cover 120 is coupled to the heat sink 110 to cover the upper side of the heat sink 110.

As described above, the printed circuit board 140 is mounted on the upper surface of the heat sink 110.

Further, the heat sink 110 is integrally formed at a lower side thereof with a plurality of heat dissipation fins 118. The heat sink 110 includes a main region 111 formed on the upper surface thereof and having the printed circuit board 140 mounted thereon, and an elongated rectangular depression region 112 defined inside the main region 111.

The depression region 112 defines the main region 111 in a substantially rectangular loop shape. The depression region 112 and the main region 111 have flat bottom surfaces.

As described below in detail, a driving circuit board 160 is mounted on the depression region to drive the optical semiconductor device 150 or an optical semiconductor chip 152 of the optical semiconductor device 150.

Advantageously, the printed circuit board 140 is a metal core PCB (MCPB) based on a metal having high thermal conductivity.

Alternatively, the printed circuit board 140 may be a general FR4 PCB.

The heat sink 110 is integrally formed with a rectangular loop-shaped inner wall 113, which surrounds the main region 111.

The inner wall 113 vertically protrudes from the upper surface of the heat sink 110 so as to correspond to an insertion type edge section 124 of the light-transmitting optical cover 120 described below.

Further, the inner wall 113 is formed along the edge of the heat sink 110. Further, the heat sink 110 includes an inserting section formed near the inner wall 113 and corresponding to the edge section 124.

Meanwhile, a valley is formed to a predetermined depth along a border between the inner wall 113 and the main region 111.

Further, the heat sink 110 is integrally formed with an outer wall 114 along the perimeter of the inner wall 113.

Each of the inner wall 113 and the outer wall 114 may have a constant height, and the inner wall 113 may have a greater height than the outer wall 114.

A rectangular loop-shaped sealing member 130 is inserted into the grooved inserting section between the inner wall 113 and the outer wall 114 and seals a gap between the heat sink 110 and the optical cover 120 while being compressed by the edge section 124 when coupled with the optical cover 120.

The optical cover 120 includes a light-transmitting cover plate 121, which is formed by injection molding of a light-transmitting plastic resin and is integrally formed with a is plurality of lens sections 122.

Further, the optical cover 120 is integral with the rectangular loop-shaped edge section 124 formed along the circumference of the cover plate 121 and extending downwards.

The edge section 124 is integrally formed with a plurality of hooks 128 partially bent outwards therefrom and having elasticity.

The hooks 128 may be arranged at substantially constant intervals along the edge section 124.

A plurality of engagement slits 1142 corresponding to the plurality of hooks 128 is formed on an inner side of the outer wall inside the inserting groove of the heat sink 110.

In this embodiment, as a securing means for coupling the optical cover 120 to the heat sink 110, the lighting apparatus includes the hooks 128 and the engagement slits 1142 as described above. However, it can be contemplated that the heat sink can be secured to the optical cover using, for example, a fastening member, which is fastened to the heat sink and the optical cover through a penetrating portion formed on one side of the optical cover and a fastening hole formed on the heat sink and corresponding to the penetrating portion.

When the optical cover 120 is coupled to the heat sink 110, the edge section 124 of the optical cover 120 is inserted into the loop-shaped inserting section between the inner and outer walls 113, 114 of the heat sink 110 while compressing the sealing member 130.

At this time, hooks 1242 of the edge section 124 (see FIG. 14) engage with the engagement slits 1142 (see FIG. 12), so that the optical cover 120 is secured to the upper side of the heat sink 110.

The space defined between the optical cover 120 and the heat sink 110 may be maintained in a reliable sealing state by cooperation between the edge section 124 and the sealing member 130.

The edge section 124 may have a double-wall structure, wherein the hooks are formed only on an outer wall of the double wall structure such that sealing can be more reliably achieved by an inner wall of the double-wall structure.

Here, the installation places and number of hooks 128 may be changed according to application conditions of the light emitting modules 100. For example, when a total of 12 hooks 128 are longitudinally arranged at regular intervals of 45 mm along the optical cover 120 to have 6 hooks 128 disposed at either side of the optical cover 120, it is possible to satisfy requirements for the anti-dust and waterproof grade of outdoor security lamps or street lamps.

The printed circuit board 140 is mounted on the main region 111 of the upper surface of the heat sink 110. Some part of the printed circuit board 140 is removed corresponding to the depression region 112 inside the main region 111.

With this structure, the printed circuit board 140 includes two longitudinal is mounting sections 142 parallel to each other and a transverse mounting section 144 connecting facing ends of the longitudinal mounting sections 142 to each other in the transverse direction.

The main region 111 has a larger area at one side thereof than at the other side thereof facing the one side in the longitudinal direction, and the transverse mounting section 144 is placed on the larger area at the one side thereof.

In this way, two rows of optical semiconductor devices 150 are arranged at constant intervals on the printed circuit board 140.

On one of the longitudinal mounting sections 142, six optical semiconductor devices 150 in the first row are arranged at constant intervals, and on the other longitudinal mounting section 142, six optical semiconductor devices 150 of the second row are arranged at constant intervals.

The optical semiconductor devices 150 of the first row and the optical semiconductor devices 150 of the second row are symmetrical to each other centered on the depression region 112, so that the respective optical semiconductor devices 150 on one longitudinal mounting section 142 face the optical semiconductor devices 150 on the other longitudinal mounting section 142.

Since each optical semiconductor device 150 includes an optical semiconductor chip such as a light emitting diode chip, arrangement of the optical semiconductor chips is complies with the arrangement of the optical semiconductor devices 150.

The driving circuit board 160 is mounted on a bottom surface of the depression region 112 and includes circuit components for operating the optical semiconductor devices 150 or the optical semiconductor chips.

Such placement of the driving circuit board 160 on the depression region 112 below the main region may significantly reduce a possibility of the driving circuit board 160 and the circuit components thereon being positioned on a traveling passage of light emitted from the optical semiconductor devices 150, thereby providing a great contribution to reduction of optical loss.

Referring to FIG. 16, each of the optical semiconductor devices 150 includes a chip base 151, an optical semiconductor chip 152 mounted on the chip base 151, and an encapsulation material 153 formed on the chip base 151 to encapsulate the optical semiconductor chip 152.

In this embodiment, the chip base 151 may be a ceramic substrate having a pattern of terminals.

Alternatively, a reflector having a lead frame and made of a resin material may be used as the chip base.

The walls 113, 114 of the heat sink 110, particularly, the inner wall 113 of the is heat sink 110, surround the main region 111 of the heat sink 110 having the optical semiconductor devices 150 thereon, and thus the optical semiconductor devices 150 are adjacent the inner wall 113.

When light emitted from the optical semiconductor devices 150 collides with the inner wall 113, there can be significant optical loss. Thus, it is desirable that light emitted from the optical semiconductor device 150 be discharged directly through the optical cover 120 without passing through the inner wall 113.

When the height of the optical semiconductor device 150 is greater than that of the inner wall 113, it is possible to significantly reduce the amount of light colliding with the inner wall 113.

Furthermore, since the light mainly passes through upper surfaces of the optical semiconductor chips 152, it is advantageous that the height of the optical semiconductor chip 152 in the optical semiconductor device 150 is higher than that of the inner wall 113.

In this embodiment, since the height of the outer wall of the heat sink 110 is lower than that of the inner wall 113, the height of the outer wall 114 is not significantly contemplated.

As used herein, an upper end of a body of the optical semiconductor device means an upper portion of the body of the optical semiconductor device except for a light-transmitting encapsulation material or a light-transmitting lens covering the optical semiconductor chip.

For example, for an optical semiconductor device including a light-transmitting encapsulation material and a reflector having a cavity for a light-transmitting lens as a chip base, the upper end of the reflector constitutes the upper end of the body of the optical semiconductor device.

In addition, when the optical semiconductor chip 152 is mounted on a flat chip base 151 like a ceramic substrate as shown in FIG. 16, the upper end of the optical semiconductor chip 152 constitutes the upper end of the body of the optical semiconductor device.

In some embodiments, the encapsulation material has the same height as that of the reflector. In this case, the upper end of the optical semiconductor device is defined as having the same height as that of the body of the optical semiconductor device.

FIG. 17 shows part of a light emitting module, in which an optical semiconductor device 150 includes an optical semiconductor chip mounted on a reflector type chip base 151 having a cavity.

Referring to FIG. 17, an optical semiconductor chip 152 is placed below an upper end of a body of the optical semiconductor device 150, that is, on the chip base 151. Thus, is the chip base 151, that is, the upper end of the body of the optical semiconductor device, is placed above the upper end of the inner wall 113.

At this time, the upper end of the optical semiconductor device 150, that is, an upper end of the light-transmitting encapsulation material 153, is also placed above the upper end of the inner wall 113.

The optical cover 120 includes a substantially light-transmitting cover plate 121 and a plurality of lens sections 122 disposed in a predetermined arrangement on the cover plate 121.

As described above, the optical cover 120 is formed by molding a light-transmitting plastic resin, and the lens sections 122 are formed thereon during molding.

Each of the lens sections 122 is formed on the cover plate 121 at a place corresponding to each of the optical semiconductor devices 150.

Figure 18:
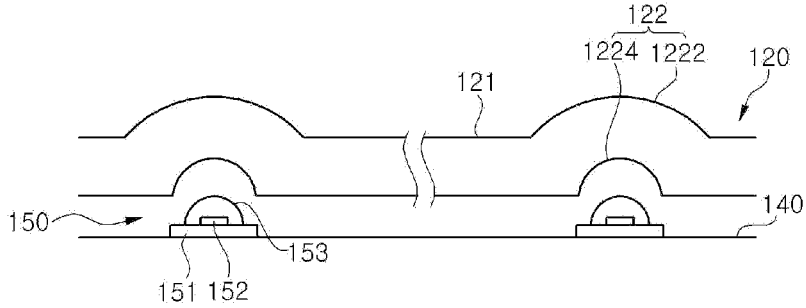
FIG. 18 to FIG. 20 are cross-sectional views of optical covers having various lenses in accordance with various embodiments of the present invention.
Figure 19:
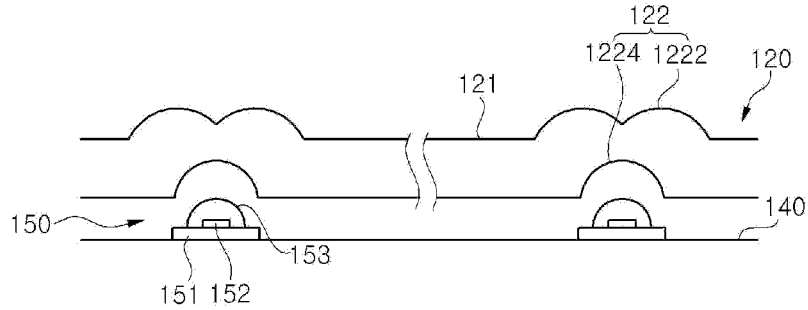
Figure 20:
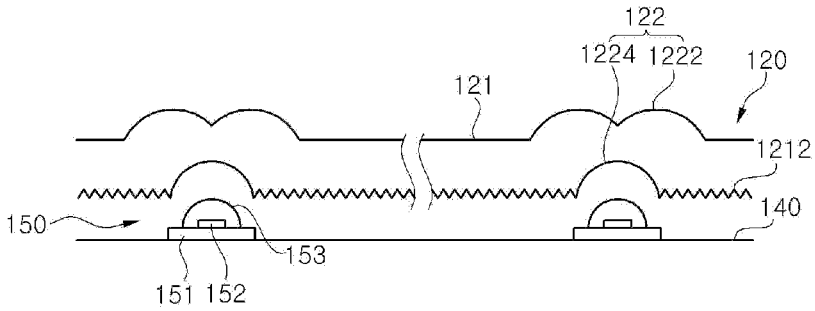

FIGS. 18 to 20 are cross-sectional views of optical covers having various lenses in accordance with various embodiments of the present invention.

As best shown in FIG. 18, in the optical cover 120, a front side of the cover plate 121 constitutes a light emission plane and a rear side of the cover plate 121 constitutes a light incidence plane.

Each of the lens sections 122 includes a convex portion 1222 formed on the front is side of the cover plate 121 and a concave portion 1224 formed on the rear side of the cover plate 121.

The convex portion 1222 may have a different radius of curvature than the concave portion 1224.

For example, the convex portion 1222 may have a substantially elliptical convex shape having a major axis and a minor axis in top plan view.

The convex portion 1222 provides an essential function for the lens section to change an orientation pattern of light.

Further, the concave portion 1224 may have a semi-circular or parabolic cross-section.

The concave portion 1224 primarily changes the orientation pattern of light entering the optical cover 120 and transmits the light to the convex portion 1222.

In this embodiment, the lens sections 122 serve to spread light emitted at a small orientation angle from a predetermined number of optical semiconductor devices.

The concave portion 1224 is separated from the optical semiconductor devices 150. A difference in the index of refraction between the lens sections 122 and air also serves as a major factor in spreading the light.

FIG. 19 shows an optical cover according to another embodiment. In FIG. 19, is the convex portion 1222 of the lens section 122 is concavely depressed at a central region thereof.

The depressed region is also defined by a round surface. With this structure, the lens sections 122 may relatively increase the amount of light directed towards an outer perimeter thereof while reducing the amount of light directed towards the center thereof.

FIG. 20 shows an optical cover according to a further embodiment.

In FIG. 20, the optical cover 120 has an undulating pattern 1212 formed on the cover plate 121 to change the orientation pattern of light.

The undulating pattern 1212 may serve to change the orientation pattern of light, which is emitted from the optical semiconductor device 150 and reflected to a reflection plane of the printed circuit board 140 instead of passing through the lens sections 122.

In this embodiment, the undulating pattern 1212 is illustrated as being formed on the rear side of the cover plate 121, but it can be contemplated that the undulating pattern 1212 is formed on the front side of the cover plate 121.

In other embodiments, the optical cover 120 may include an optical diffusion material or an optical diffusion film in order to increase or decrease brightness and illumination area.

Here, the optical diffusion material may contain organic particles such as PMMA is or silicone beads.

It may be contemplated that the optical cover further include a separate plate disposed between the optical semiconductor device and the optical cover to achieve diffuse reflection of light emitted from the optical semiconductor device.

The light emitting module may further include a wavelength conversion unit for wavelength conversion of light emitted from the optical semiconductor chip 152 within the optical semiconductor device 150. For example, the wavelength conversion unit may be directly formed on the optical semiconductor chip 152 by conformal coating. Alternatively, the wavelength conversion unit may be included in the encapsulation material which encapsulates the optical semiconductor device 150.

When the wavelength conversion unit is provided to the optical cover 120, the wavelength conversion unit may be disposed to cover the cover plate 121 and the lens sections 122.

In the above description, the optical semiconductor devices 150 each including the chip base 151, the optical semiconductor chip 152 mounted on the chip base 151 and the light-transmitting encapsulation material 153 formed on the chip base 151 to encapsulate the optical semiconductor chip 152 have been illustrated as being mounted on the printed circuit board 110.

However, a chip-on-board (COB) type light emitting module including optical semiconductor chips directly mounted on a printed circuit board 140 may be contemplated. In this case, the light-transmitting encapsulation material is directly formed on the printed circuit board 140 such that the optical semiconductor chips can be entirely or individually covered by the encapsulation material.

In this case, a single optical semiconductor device is constituted by a single optical semiconductor chip directly disposed on the printed circuit board and a light-transmitting encapsulation material formed on the optical semiconductor chip.

In the case where a single light-transmitting encapsulation material covers all of the optical semiconductor chips on the printed circuit board, it is regarded that a plurality of optical semiconductor devices is disposed on the printed circuit board.

Even in this case, an upper end of the optical semiconductor device is constituted by an upper end of the encapsulation material, and an upper end of the body of the optical semiconductor device is constituted by an upper end of the optical semiconductor chip.

The idea of the present invention is applied not only to a light emitting module applicable to the lighting apparatus according to the embodiments of the present invention, but also to light emitting modules for other lighting apparatuses.

Figure 21:
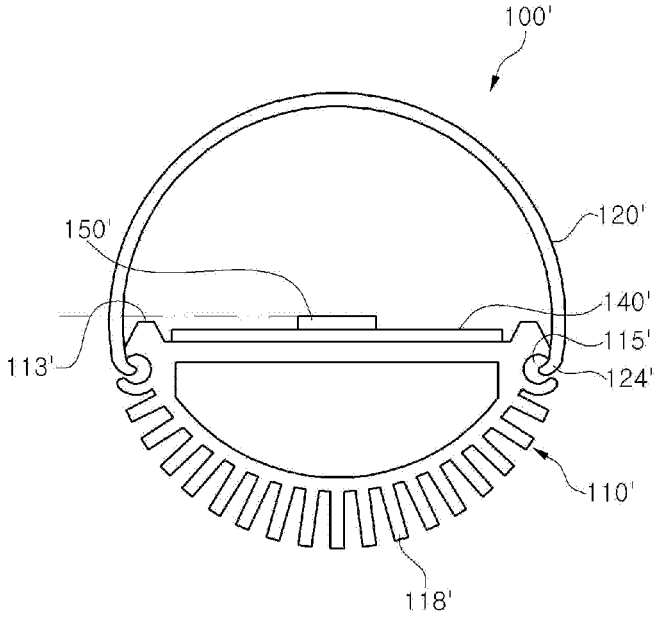
FIG. 21 is a cross-sectional view of a light emitting module applied to a tube type or a fluorescent lamp type lighting apparatus, in accordance with one embodiment of the present invention.
Figure 22:
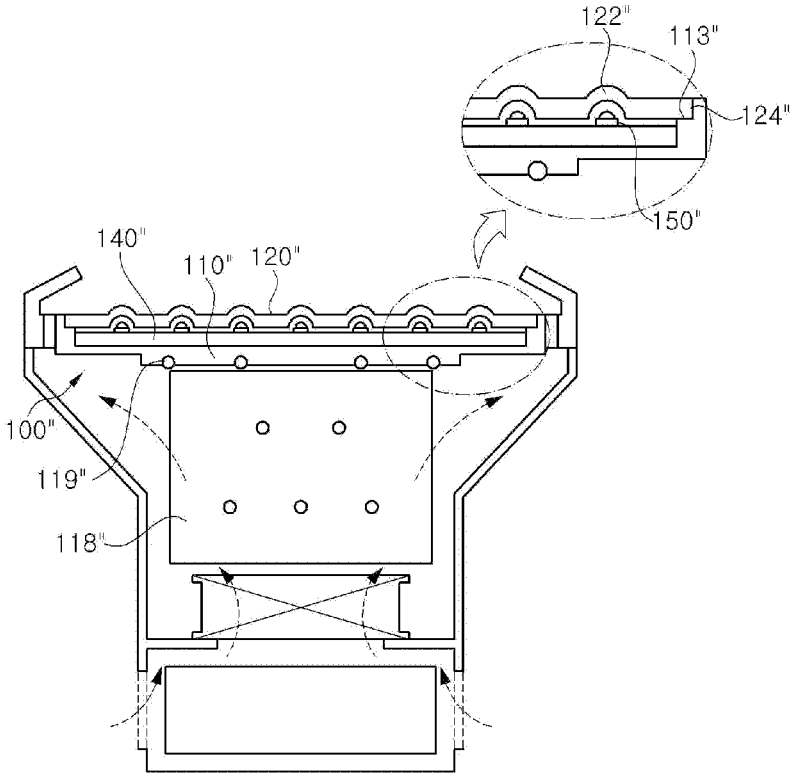
FIG. 22 is a cross-sectional view of the light emitting module applied to a factory light-type lighting apparatus, in accordance with another embodiment of the present invention.

FIG. 21 is a cross-sectional view of a light emitting module applied to a tube is type or a fluorescent lamp type lighting apparatus, in accordance with one embodiment of the present invention, and FIG. 22 is a cross-sectional view of a light emitting module applied to a factory light-type lighting apparatus, in accordance with another embodiment of the present invention.

Referring to FIG. 21, a light emitting module 100' according to this embodiment includes a heat sink 110' as a heat dissipation member, a printed circuit board 140' disposed on a flat upper surface of the heat sink 110', and a plurality of optical semiconductor devices 150' (only one optical semiconductor device is shown) disposed on the printed circuit board 140'.

The heat sink 110' is integrally formed with a plurality of heat dissipation fins 118' along a lower circumference thereof.

The heat sink 110' has an inner wall 113' protruding from the upper surface thereof, on which the printed circuit board 140' is mounted, so that an upper end of the heat sink is placed above the upper surface thereof by the inner wall.

The light emitting module 100' further includes a light-transmitting optical cover 120' having a semi-circular-shaped cross-section and coupled to the heat sink 110'. The light-transmitting optical cover 120' completely covers an upper side of the heat sink 110'.

As described above, the inner wall 113' protruding from the upper surface of the is heat sink 110' is placed corresponding to an edge section 124' of the light-transmitting optical cover 120'.

At this time, upper ends of the optical semiconductor devices 150' are placed above the upper end of the inner wall 113'.

Furthermore, the body of each of the optical semiconductor devices 150' is placed above the upper end of the inner wall 113'.

On the heat sink 110', the inner wall 113' is formed along right and left edges of the upper surface and an inserting section 115' is formed near the inner wall 113' corresponding to the edge section 124' of the light-transmitting optical cover 120.

The light-transmitting optical cover 120 is secured to the heat sink 120' by slidably inserting the edge section 124' into the inserting section 115'.

Although not shown in the drawings, the light-transmitting optical cover 120' may have an undulating pattern formed on at least one surface thereof.

Referring to FIG. 22, a light emitting module 100" according to this embodiment includes a heat dissipation member 110", a printed circuit board 140" disposed on a flat upper surface of the heat dissipation member 110", and a plurality of optical semiconductor devices 150" mounted on the printed circuit board 140".

The heat dissipation member 110" is provided at a lower side thereof with a is plurality of heat pipes 119".

Further, the heat dissipation member 110" is provided with a plurality of plate-shaped heat dissipation fins 118" under the heat pipe 119" to perform heat dissipation in cooperation with the heat pipe 119".

The heat dissipation member 110" has an inner wall 113" protruding from the upper surface thereof, on which the printed circuit board 140" is mounted, so that an upper end of the heat dissipation member is placed above the upper surface thereof by the inner wall 113".

Further, the light emitting module 100" includes a light-transmitting optical cover 120" coupled to the heat sink 110". The light-transmitting optical cover 120" covers an upper side of the heat sink 110".

The optical semiconductor devices 150" may be designed to have upper ends placed above the upper end of the inner wall 113".

The optical cover 120" includes an edge section 124", which is inserted into and secured to an inserting section formed near the inner wall 113".

The optical cover 120" includes a lens section 122" corresponding to each of the optical semiconductor devices 150".

Figure 23:
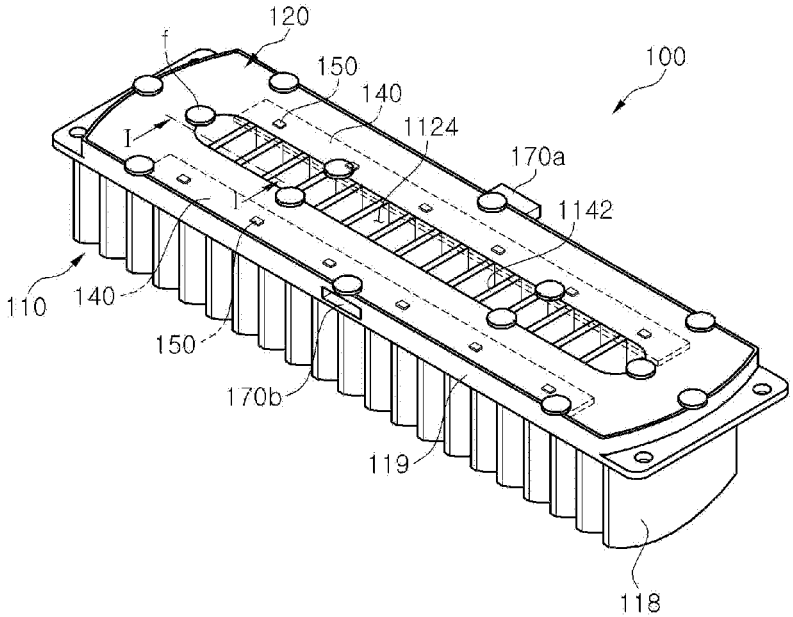
FIG. 23 is a perspective view of a light emitting module in accordance with a further embodiment of the present invention.
Figure 24:
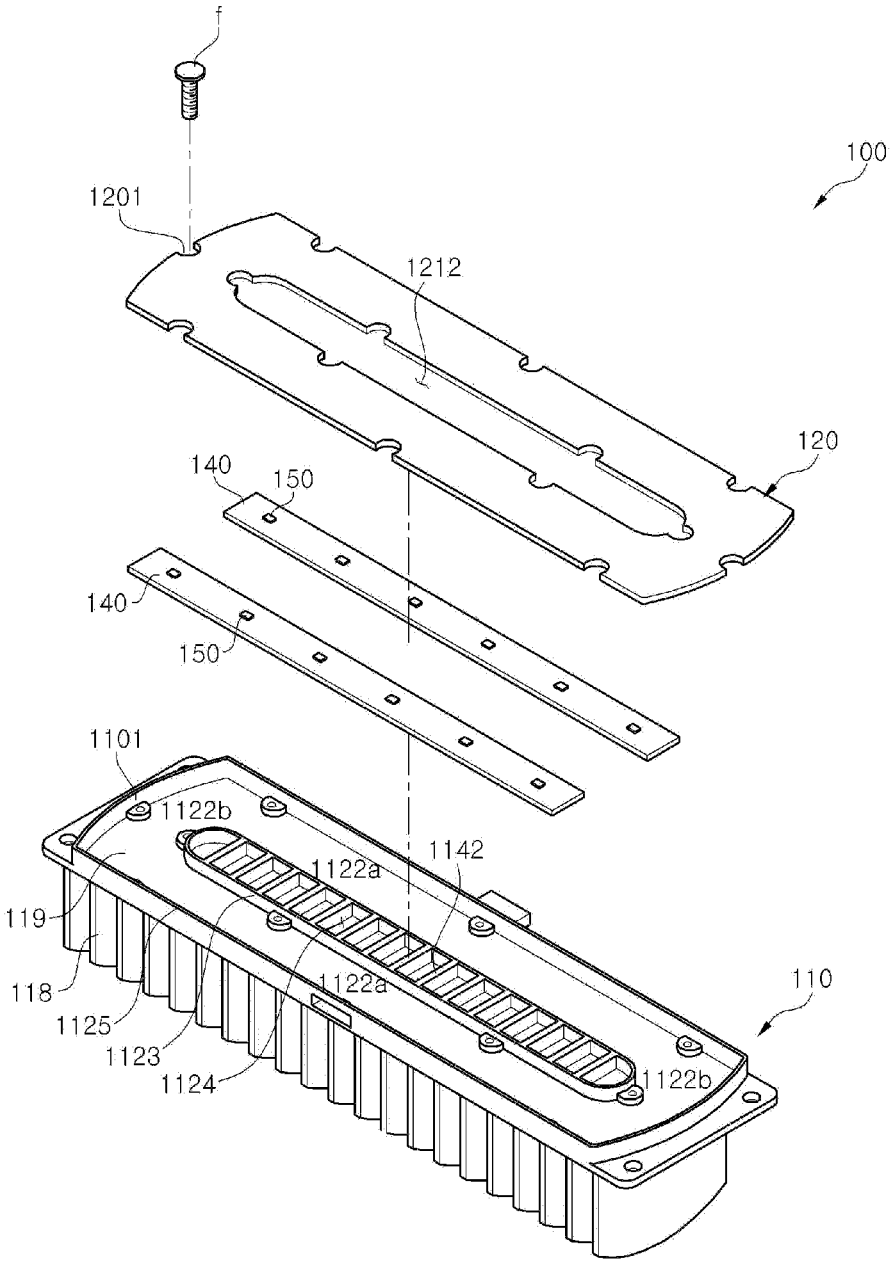
FIG. 24 is an exploded perspective view of the light emitting module shown in FIG. 23.
Figure 25:
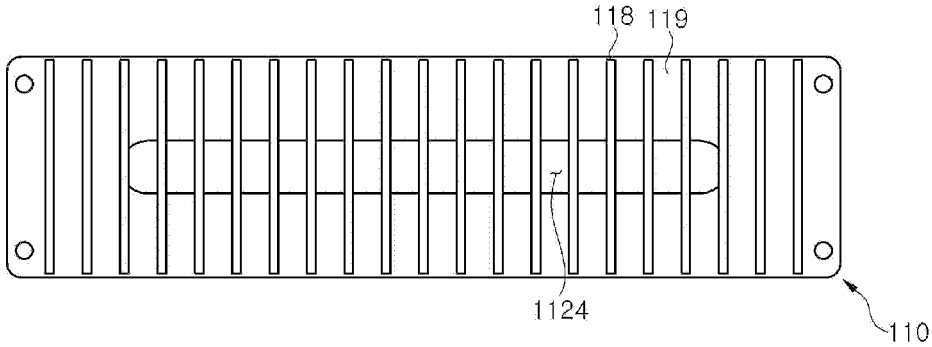
FIG. 25 is a bottom view of the light emitting module shown in FIGS. 23 and 24.
Figure 26:
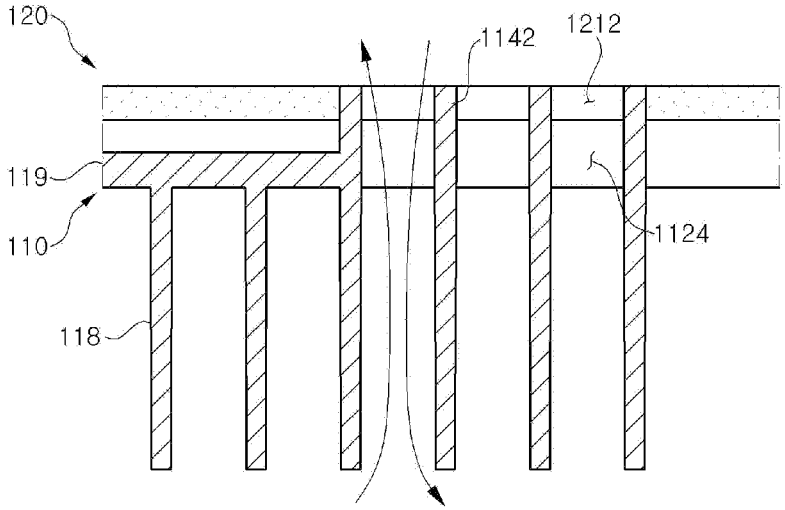
FIG. 26 is a cross-sectional view of the light emitting module taken along line I-I of FIG. 1.

FIG. 23 is a perspective view of a light emitting module in accordance with another embodiment of the present invention; FIG. 24 is an exploded perspective view of the is light emitting module shown in FIG. 23; FIG. 25 is a bottom view of the light emitting module shown in FIGS. 23 and 24; and FIG. 26 is a cross-sectional view of the light emitting module taken along line I-I of FIG. 1.

Referring to FIGS. 23 to 26, the light emitting module 100 according to this embodiment includes a heat sink 110 made of a metallic material having good thermal conductivity, an optical cover 120 coupled to an upper end of the heat sink 110, a printed circuit board 140 mounted on an upper surface of the heat sink 110 between the heat sink 110 and the optical cover 120, and a plurality of optical semiconductor devices 150 mounted on the printed circuit board 140.

The heat sink 110 has a heat dissipation base 119 having a predetermined width and length, and a plurality of heat dissipation fins 118 formed on a lower surface of the heat dissipation base 119.

The heat dissipation fins 118 are arranged at constant intervals in a longitudinal direction of the heat dissipation base 119.

Further, each of the heat dissipation fins 118 has a substantially rectangular plate shape having a length corresponding to the width of the heat dissipation base 119 and is configured to traverse the heat dissipation base 119 in the width direction.

The heat sink 110 includes an air flow hole 1124 formed through the heat is dissipation base 119 such that the heat dissipation fins 118 are exposed therethrough.

The air flow hole 1124 is formed in a central region of the heat dissipation base 119 in the longitudinal direction of the heat dissipation base 119.

Upper ends of the heat dissipation fins 118 are exposed outside the heat sink 110 through the air flow hole 1124.

In this embodiment, some of the heat dissipation fins placed near opposite ends of the heat sink 110 in the longitudinal direction are placed outside the air flow hole 1124 and thus are not exposed through the air flow hole 1124.

All of the heat dissipation fins 118 placed inside the air flow hole 1124 integrally include upward extending portions 1142.

The upward extending portions 1142 of the heat dissipation fins 118 extend above an upper surface of the heat dissipation base 119 through the air flow hole 1124.

The heat dissipation fins 118 and the upward extending portions 1142 thereof divide the air flow hole 1124 into a plurality of cell-type openings.

Air can cool the heat dissipation fins 118 while passing through the cell-type openings.

The heat dissipation base 119 is provided on the upper surface thereof with an elongated ring-shaped mounting region near the air flow hole 1124.

Further, an elongated protruding step wall 1123 is formed along the air flow hole 1124 to define an inner side of the air flow hole 1124.

The protruding step wall 1123 is disposed between the air flow hole 1124 and the mounting region to divide the mounting region from the air flow hole 1124.

At this time, each of the upward extending portions 1142 is connected at both ends thereof with the protruding step wall 1123.

The mounting region includes a pair of longitudinal regions 1122*a* placed at both sides of the heat dissipation base 119 to face each other in the transverse direction.

The air flow hole 1124 and the protruding step wall 1123 are placed between the pair of longitudinal regions 1122*a*.

Further, the mounting region includes a pair of transverse regions 1122*b* placed at opposite sides of the air flow hole 1124 to connect facing ends of the longitudinal regions 1122*a* to each other.

Further, the heat dissipation base include a protruding step 1125 formed along an edge of the mounting region.

The printed circuit board 140 is mounted on the mounting region of the heat dissipation base 119. In this embodiment, two elongated bar-shaped printed circuit boards 140 are mounted on the pair of longitudinal regions 1122*a*, respectively.

Each of the printed circuit board 140 has a plurality of optical semiconductor devices 150 mounted thereon.

The plurality of optical semiconductor devices 150 are arranged at constant intervals in a longitudinal direction of the printed circuit board 140.

Advantageously, the printed circuit boards 140 are metal core PCBs (MCPB based on a metal having high thermal conductivity. Alternatively, the printed circuit boards 140 may be general FR4 PCBs.

Advantageously, the plurality of optical semiconductor devices 150 are LEDs. Herein, the LED may be an LED package including an LED chip within the package structure. Alternatively, the LED may be an LED chip directly mounted on the printed circuit board 140 in a chip-on-board manner.

In addition, other kinds of optical semiconductor devices may be used instead of the LED.

The optical cover 120 is coupled to the protruding step 1125 formed along the edge of the heat sink 110.

In this embodiment, the optical cover 120 is coupled to the heat sink 110 using fasteners (f) such as bolts.

Each of the heat sink 110 and the optical cover 120 includes fastening grooves and holes 1201, 1101 for fastening with the fasteners (f).

The optical cover 120 has an opening 1212 through which the air flow hole 1124 is exposed.

The opening 1212 is formed to a size and shape corresponding to the size and shape of the air flow hole 1123 in a central region of the optical cover 120 in the longitudinal direction of the optical cover 120.

The opening 1212 exposes the air flow hole 1124, the heat dissipation fins 118 inside the air flow hole 1124, and the upward extending portions 1142 thereof to air outside the optical cover 120.

The optical cover 120 may be formed by injection molding, for example, a light-transmitting plastic resin.

Furthermore, the protruding partition wall 1123 surrounding the air flow hole 1124 may be inserted into the opening 1212.

At this time, it is desirable to prevent moisture or foreign matter from intruding into the optical cover 120, in which the printed circuit boards 140 and the optical semiconductor devices 150 are placed, by blocking a gap between an inner surface of the opening 1212 and an outer surface of the protruding partition wall 1123.

As a method for blocking the gap, it can be contemplated that the protruding is partition wall 1123 can be inserted into the opening 1212 via interference fitting. Alternatively, it can be contemplated that a sealing member can be interposed between the opening 1212 and the protruding partition wall 1123.

As indicated by an arrow in FIG. 26, air may flow through the light emitting module 100 in the vertical direction via the air flow hole 1124 of the heat sink 110 and the opening 1212 of the optical cover 120 by natural blowing or forcible blowing.

Further, air flow passages defined in the vertical direction in the air flow hole 1124 and the opening 1212 are arranged in the longitudinal direction along the central region of the heat sink 110, thereby significantly reducing thermal delay, which conventionally occurs in the central region of the heat sink 110 in the art.

Further, since the heat dissipation fins 118 extend above the heat sink 110 through the air flow hole 1124 to form the upward extending portions 1142, the heat dissipation fins 118 have larger surface areas than conventional heat dissipation fins without increasing the size of the light emitting module 100, thereby improving heat dissipation characteristics.

Figure 27:
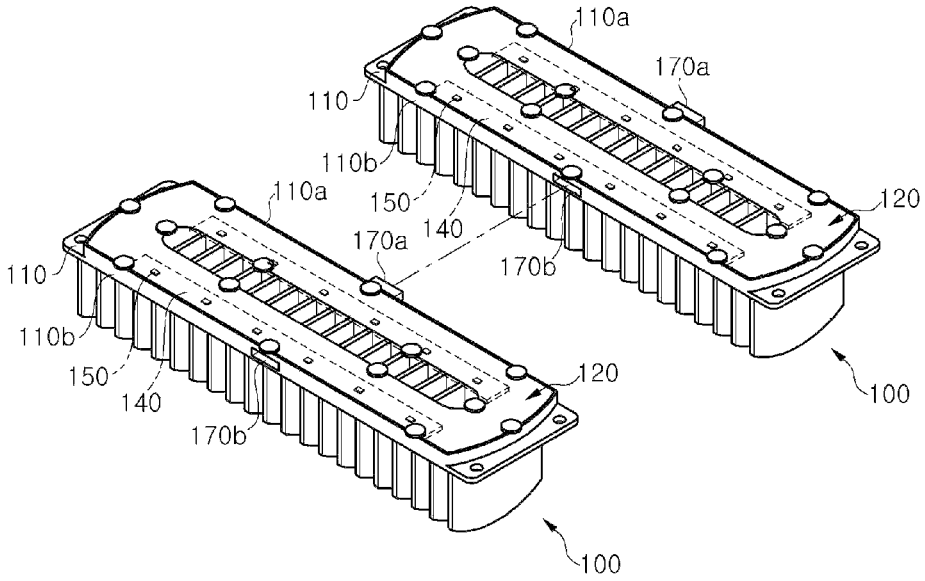
FIG. 27 is a view illustrating an electrical connection structure between plural light emitting modules in accordance with another embodiment of the present invention.

FIG. 27 is a view illustrating an electrical connection structure between plural light emitting modules.

Referring to FIG. 27, two light emitting modules 100 are shown. With longer sides of the light emitting modules 100 disposed to face each other, the two light emitting is modules 100 are provided to a lighting apparatus, such as a street lamp, a security lamp, a factory lamp, and the like.

Further, each of the light emitting modules 100 includes a male connector 170*a* disposed on a first side 110*a* of the heat dissipation base 119 of the heat sink 110 and a female connector 170*b* disposed on a second side 110*b* thereof facing the first side 110*a*.

When the two light emitting modules 100 are brought into contact with each other such that the longer side of one light emitting module faces the longer side of the other light emitting module, the male connector 170*a* of the one light emitting module 100 is inserted into the female connector 170*b* of the other light emitting module 100.

As a result, the one light emitting module 100 is electrically connected to the other light emitting module 100.

When the male connector 170*a* is separated from the female connector 170*b* by separating the one light emitting module 100 from the other light emitting module 100, electrical connection between the two light emitting modules is released.

Two light emitting modules are illustrated in the specification and drawing for convenience of illustration in this embodiment. However, it should be understood that three or more adjacent light emitting modules of a lighting apparatus may be electrically connected to each other via connection between the male connectors 170*a* and the female connector 170*b*.

With this structure, a complicated wire connection structure and other components for supplying power from a power source (not shown) of the lighting apparatus to the plurality of light emitting module via a main power line can be eliminated, and a complex process for connecting wires between the light emitting modules 100 can be substituted by simple operation of connecting a male connector of a light emitting module 100 to a female connector of another light emitting module 100 adjacent thereto.

Figure 28:
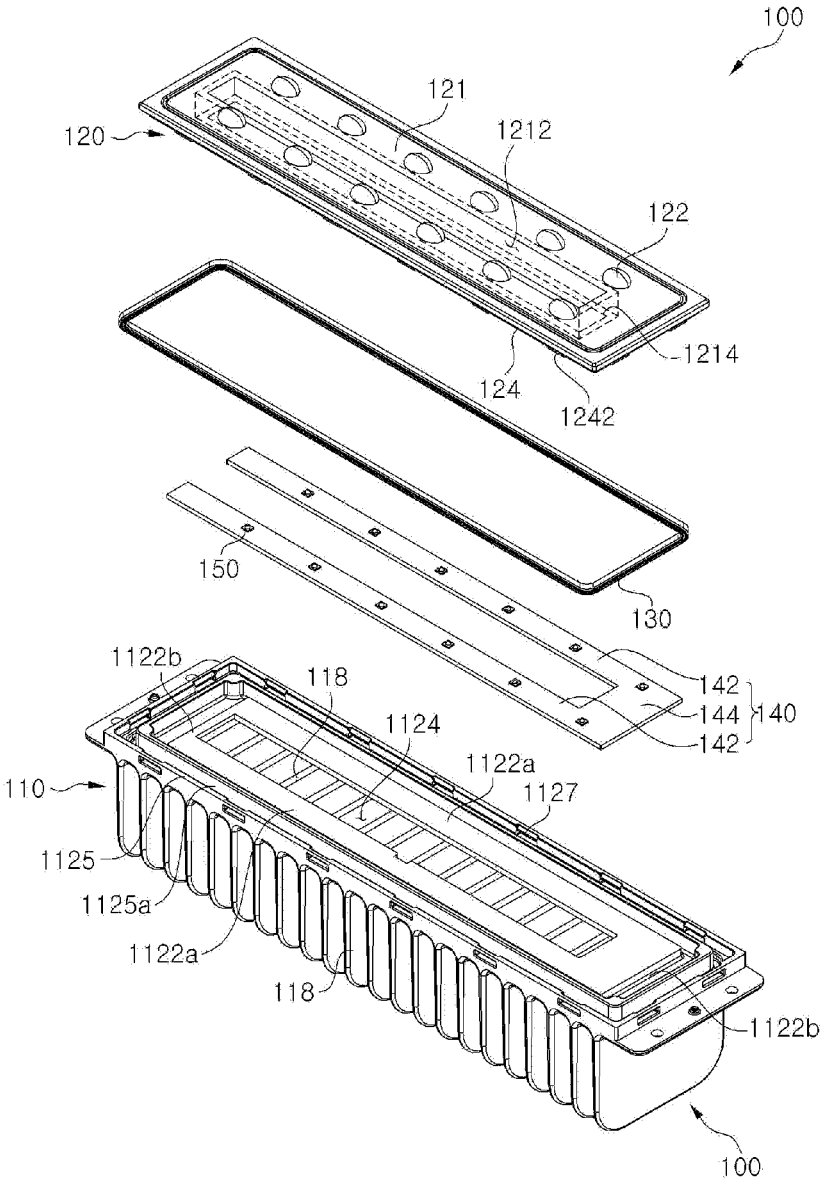
FIG. 28 is an exploded perspective view of a light emitting module in accordance with yet another embodiment of the present invention.

FIG. 28 is an exploded perspective view of a light emitting module in accordance with yet another embodiment of the present invention.

Referring to FIG. 28, the light emitting module 100 according to this embodiment uses a single printed circuit board 140, which includes two longitudinal mounting sections 142 and a transverse mounting section 144 connecting facing ends of the longitudinal mounting sections 142 to each other in a transverse direction, unlike the embodiment described above.

When the printed circuit board 140 is mounted on the heat dissipation base 119, the two longitudinal mounting sections 142 are longitudinally placed on a pair of longitudinal regions 1122*a*, respectively, and the transverse mounting section 144 is placed on one of a pair of transverse arrears 1122*b*.

Alternatively, a rectangular ring-shaped printed circuit board including two is longitudinal mounting sections and two transverse mounting sections may be used. In this case, each of the transverse mounting sections of the printed circuit board may be placed on a pair of transverse regions 1122*b* provided to the mounting region of the heat dissipation base 119.

Further, as shown in the drawings, the mounting region may have a protruding step shape of a certain height.

Further, the light emitting module 100 according to this embodiment includes an inserting groove 1125*a* defined on the protruding step 1125 formed along an upper edge of the heat dissipation base 119.

A rectangular sealing member 130 may be inserted into the inserting groove 1125*a*.

Further, the optical cover 120 includes a light-transmitting cover plate 121, which is formed by injection molding a light-transmitting plastic resin and is integrally formed with a plurality of lens sections 122 disposed in a certain arrangement, and a rectangular inserting section 124 extending downwards from the cover plate 121 along the circumference thereof.

The inserting section 124 is integrally formed with a plurality of hooks 1242 partially bent outwards therefrom and having elasticity.

The plural hooks 1242 may be arranged at substantially constant intervals along the inserting section 124.

A plurality of engagement slits 1127 corresponding to the plurality of hooks 1242 is formed on an inner side of the inserting groove 1125*a* of the heat sink 110.

When the optical cover 120 is coupled to an upper side of the heat sink 110, the inserting section 124 of the optical cover 120 is inserted into the inserting groove 1125*a* while compressing the sealing member 130.

At this time, the hooks 1242 of the optical cover 120 engage with the engagement slits 1127 of the heat sink 110, allowing the optical cover 120 to be secured to the upper side of the heat sink 110.

Cooperation between the inserting section 124 and the sealing member 130 enables more reliable sealing of the space between the optical cover 120 and the heat sink 110.

Further, the light emitting module according to this embodiment may eliminate the aforementioned fastener (f; see FIGS. 2 and 23) by the securing structure of the optical cover 120 using the hooks 1242 and the engagement slits 1127.

Further, the optical cover 120 includes an opening 1212, through which the air flow hole 1124 and the heat dissipation fins are exposed when the optical cover 120 is coupled to the heat sink 110.

The optical cover 120 may further include an inner wall 1214 which extends downwards from the circumference of the opening 1212.

In this embodiment, the heat sink 100 has an area on the air flow hole 1124, which is provided with no heat dissipation fin 118, such that the inner wall 1214 of the optical cover 120 can be inserted into the upper portion of the air flow hole 1124.

Figure 29:
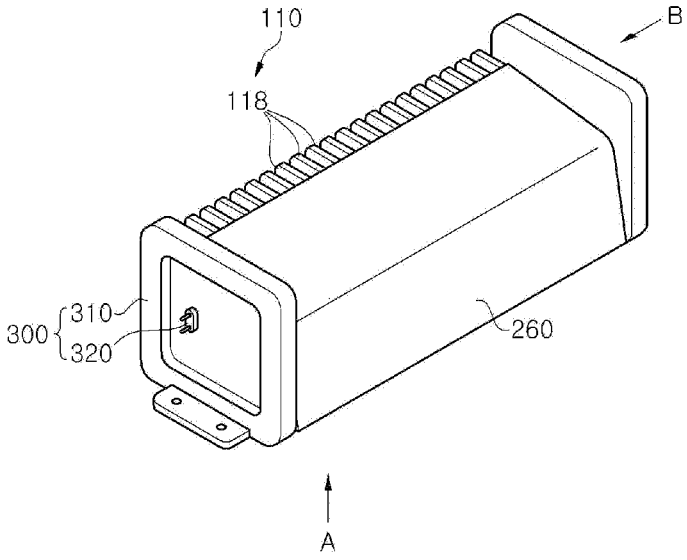
FIGS. 29 and 30 are perspective views of an optical semiconductor lighting apparatus in accordance with another embodiment of the present invention.
Figure 30:
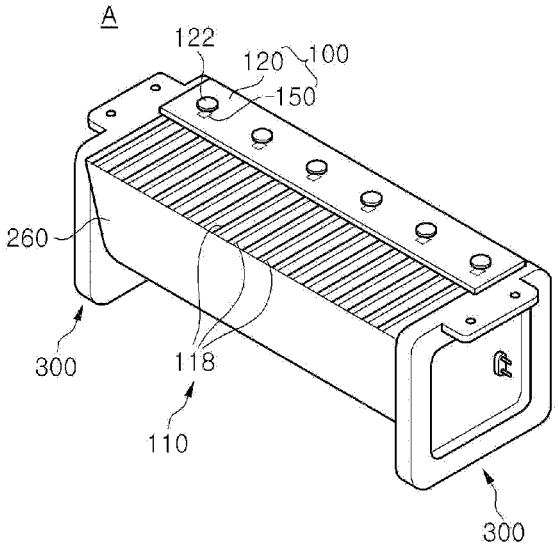

FIGS. 29 and 30 are perspective views of an optical semiconductor lighting apparatus in accordance with another embodiment of the present invention.

As shown in these figures, in the lighting apparatus according to this embodiment, a heat sink 110 of a light emitting module 100 is provided at opposite ends thereof with service units 300.

The light emitting module 100 includes at least one optical semiconductor device 150 and acts as a light source driven by a power source.

The heat sink 110 is provided to the light emitting module 100 and cools the light emitting module 100 by discharging heat from the light emitting module 100.

The service units 300 are respectively provided to opposite ends of the heat sink 110 and electrically connected to the light emitting module 100. The service units 300 are used to supply power to the light emitting module 100 or to connect adjacent light emitting modules 100 to each other.

In addition to the embodiments as described above, the present invention may be realized by various other embodiments as described below.

Figure 31:
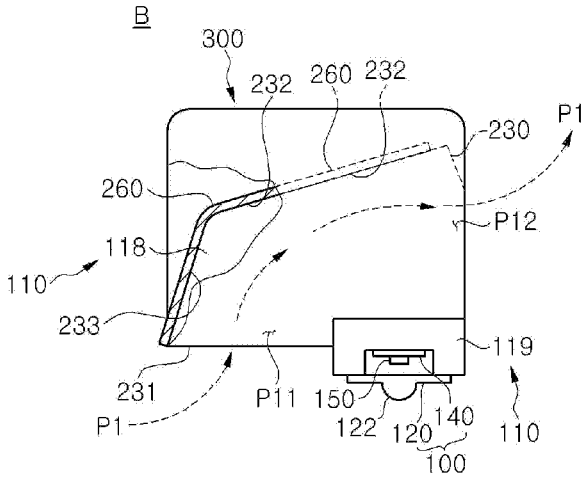
FIG. 31 is a conceptual diagram of the lighting apparatus viewed in a direction of B in FIG. 29.
Figure 32:
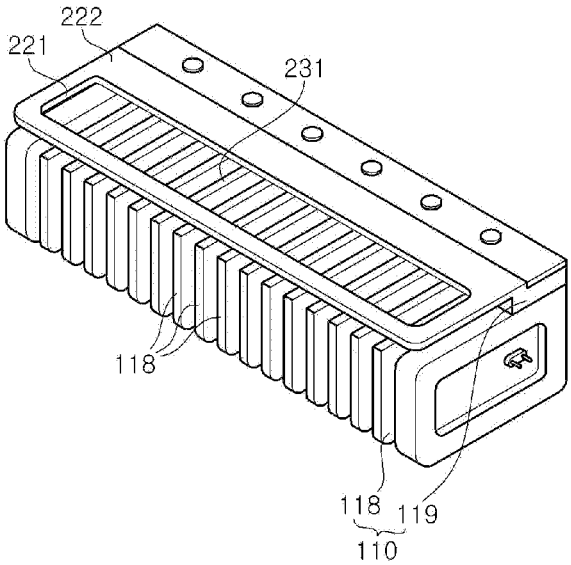
FIGS. 32 and 33 are perspective views of an optical semiconductor lighting apparatus in accordance with yet another embodiment of the present invention.
Figure 33:
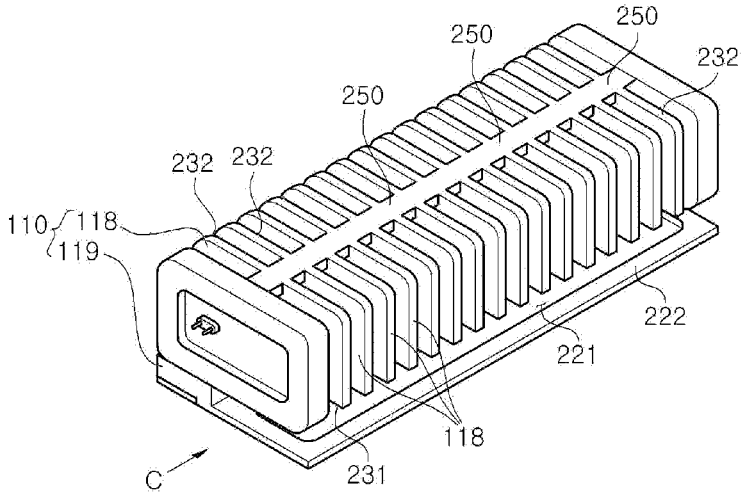
Figure 34:
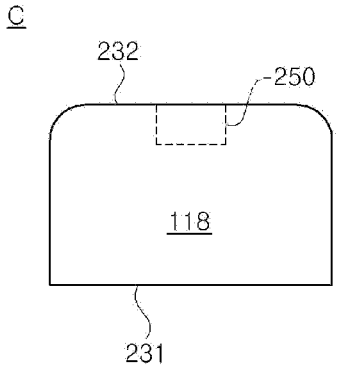
FIG. 34 is a conceptual diagram of the lighting apparatus viewed in a direction of C in FIG. 33.
Figure 35:
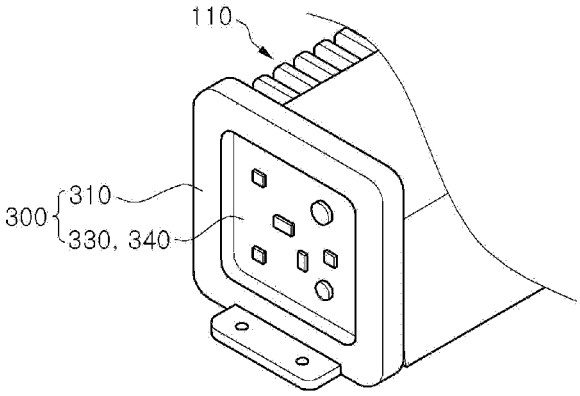
FIG. 35 is a partial perspective view of a service unit of an optical semiconductor lighting apparatus in accordance with yet another embodiment of the present invention.

FIG. 31 is a conceptual diagram of the lighting apparatus viewed in a direction of B in FIG. 29; FIGS. 32 and 33 are perspective views of an optical semiconductor lighting apparatus in accordance with yet another embodiment; FIG. 34 is a conceptual diagram of the lighting apparatus viewed in a direction of C in FIG. 33; and FIG. 35 is a partial perspective view of a service unit of an optical semiconductor lighting apparatus in accordance with yet another embodiment.

Referring to FIG. 31, the light emitting module 100 serves as a light source as described above, and includes a printed circuit board 140 having an optical semiconductor device 150 disposed thereon and an optical cover 120 having a lens 122 corresponding to the optical semiconductor device 150.

The heat sink 110 is provided to obtain heat dissipation and cooling effects through an increase in heat transfer area as described above. The heat sink 110 includes a plurality of heat dissipation fins 118 arranged in a longitudinal direction of the light emitting module 100 to be parallel to each other, and a heat dissipation base 119 disposed at one side of the heat sink 110 to connect the heat dissipation fins 118 to each other and having the light emitting module 100 mounted thereon.

Specifically, the heat sink 110 preferably has an air flow passage P1 bent with respect to the heat dissipation base 119 in a space between adjacent heat dissipation fins 118.

Here, the air flow passage P1 may be defined from an inlet P11 formed near one side of the heat dissipation base 119 at one edge 231 (hereinafter, 'first edge 231') of each of the heat dissipation fins 118 to an outlet P12 formed near the other edge 232 (hereinafter 'second edge 232') facing the first edge 231.

That is, it can be seen from FIGS. 29 and 30 that the air flow passage is defined in the space between adjacent heat dissipation fins 118.

Here, for the heat sink 110 to allow air flowing into the inlet P11 to be efficiently discharged through the outlet P12, the second edge 232 facing the first edge 231 may be slanted from one side to the other side.

For this purpose, the heat dissipation base 119 is disposed to contact one side of each of the heat dissipation fins 118, thereby allowing the air flow passage P1 to be defined thereon.

Further, the heat sink 110 may further include an air baffle 260, which covers the plurality of heat dissipation fins 118 to an edge (hereinafter, 'third edge 233') thereof extending from the second edge 232 in order to induce forcible air discharge from the inlet P11 to the outlet P12.

In an embodiment shown in FIG. 32, the heat sink 110 may further include a lip 222 extending from one side of the heat dissipation base 119 and separated from a connecting part between the heat dissipation base 119 and the heat dissipation fins 118, and an air slot 221 formed along the lip 222.

The air slot 221 may serve as an inlet of the air flow passage, and the lip 222 having the air slot 221 extends from the heat dissipation base 119 and serves to distribute and support load of the heat sink 110 and the service units 300 according to installation conditions and positions.

As shown in FIGS. 33 and 34, the heat sink 110 may further include a reinforcing rib 250, which extends from the second edge 231 and connects all of the heat dissipation fins 118 to each other in order to have structural strength, that is, endurance to torsional strength.

Meanwhile, the service units 300 serve to supply power to the light emitting module 100 or to connect adjacent light emitting modules 100 to each other, as described above. In one embodiment as shown in FIG. 29, each of the service units 300 includes a unit body 310 provided to either side of the heat sink 110 and a connector 320 formed on the unit body 310.

In other words, the connector 320 of the service unit 300 is mechanically coupled to another service unit 300 of an adjacent light emitting module 100, thereby providing electrical connection between the light emitting modules 100.

In one embodiment as shown in FIG. 35, the service unit 300 may include a driving printed circuit board 330 or a charge/discharge device 340 having a charge/discharge circuit therein within the unit body 310.

Thus, the lighting apparatus according to this embodiment may permit operation of the light emitting module 100 through the driving printed circuit board 330 and may supply emergency power to the light emitting module 100 using the charge/discharge device 340 in the event where separate power cannot be temporarily supplied thereto.

In this way, the optical semiconductor lighting apparatus according to this invention provides convenience in overhauling and repair, permits easy assembly and disassembly, and has excellent waterproof performance and endurance. In addition, the lighting apparatus according to this invention may minimize optical loss or occurrence of dark areas and may provide broad and uniform illumination via an optical cover integrally formed with lenses. Further, the lighting apparatus according to this invention may minimize optical loss caused by absorption of light by a protrusion formed on the heat sink to absorb light emitted from an optical semiconductor device or an optical semiconductor chip. Further, in the lighting apparatus according to this invention, the heat sink has an air flow passage defined from a lower side thereof to an upper side thereof to improve heat dissipation performance.

Further, for a lighting apparatus including a plurality of light emitting modules, the present invention provides an easy and reliable connection structure for electrically connecting the light emitting modules to each other. Furthermore, the optical semiconductor lighting apparatus according to the present invention has a large heat dissipation area to improve heat dissipation efficiency while providing improved cooling efficiency via natural convection.

Although some embodiments have been described in the present disclosure, it should be understood by those skilled in the art that these embodiments are given by way of illustration only, and that various modifications, variations, and alterations can be made without departing from the spirit and scope of the present invention. The scope of the present invention should be limited only by the accompanying claims and equivalents thereof.

The invention claimed is:

1. An optical semiconductor lighting apparatus comprising:

a heat sink including a heat dissipation base and a plurality of heat dissipation fins formed on a lower surface of the heat dissipation base;

an optical semiconductor device placed on the heat dissipation base; and an optical cover coupled to an upper side of the heat sink to cover the optical semiconductor device, wherein the heat dissipation base is formed with an air flow hole through which upper ends of the heat dissipation fins are exposed, and each of the heat dissipation fins is integrally formed with an upward extending portion which extend above an upper surface of the heat dissipation base through the air flow hole.

2. An optical semiconductor lighting apparatus comprising:

a heat sink including a heat dissipation base and a plurality of heat dissipation fins formed on a lower surface of the heat dissipation base;

an optical semiconductor device placed on the heat dissipation base; and an optical cover coupled to an upper side of the heat sink to cover the optical semiconductor device, wherein the heat dissipation base is formed with an air flow hole through which upper ends of the heat dissipation fins are exposed, and comprises a partition wall protruding along a circumference of the air flow hole.

3. An optical semiconductor lighting apparatus comprising:

a heat sink including a heat dissipation base and a plurality of heat dissipation fins formed on a lower surface of the heat dissipation base;

an optical semiconductor device placed on the heat dissipation base; and an optical cover coupled to an upper side of the heat sink to cover the optical semiconductor device, wherein the heat dissipation base is formed with an air flow hole through which upper ends of the heat dissipation fins are exposed, the optical cover is formed with an opening through which the air flow hole and the heat dissipation fins are exposed, and the heat dissipation base comprises a partition wall protruding along a circumference of the air flow hole and fitted into the opening of the optical cover.

4. An optical semiconductor lighting apparatus comprising:

a heat sink including a heat dissipation base and a plurality of heat dissipation fins formed on a lower surface of the heat dissipation base;

an optical semiconductor device placed on the heat dissipation base; and an optical cover coupled to an upper side of the heat sink to cover the optical semiconductor device, wherein the heat dissipation base is formed with an air flow hole through which upper ends of the heat dissipation fins are exposed, each of the heat dissipation fins is integrally formed with an upward extending portion which extend above an upper surface of the heat dissipation base through the air flow hole, the heat dissipation base comprises a partition wall protruding along a circumference of the air flow hole, and the upper extending portion of the heat dissipation fin is connected at both sides thereof to the partition wall.

5. The optical semiconductor lighting apparatus according to claim 1, wherein the heat dissipation base comprises a circuit board mounting region around of the air flow hole, and the circuit board comprises a plurality of optical semiconductor devices mounted thereon.

6. The optical semiconductor lighting apparatus according to claim 2, wherein the heat dissipation base comprises a circuit board mounting region around the air flow hole, and the circuit board comprises a plurality of optical semiconductor devices mounted thereon.

7. The optical semiconductor lighting apparatus according to claim 3, wherein the heat dissipation base comprises a circuit board mounting region around the air flow hole, and the circuit board comprises a plurality of optical semiconductor devices mounted thereon.

8. The optical semiconductor lighting apparatus according to claim 4, wherein the heat dissipation base comprises a circuit board mounting region around the air flow hole, and the circuit board comprises a plurality of optical semiconductor devices mounted thereon.

9. The optical semiconductor lighting apparatus according to claim 1, wherein the optical cover comprises a lens portion corresponding to the optical semiconductor device.

10. The optical semiconductor lighting apparatus according to claim 2, wherein the optical cover comprises a lens portion corresponding to the optical semiconductor device.

11. The optical semiconductor lighting apparatus according to claim 3, wherein the optical cover comprises a lens portion corresponding to the optical semiconductor device.

12. The optical semiconductor lighting apparatus according to claim 4, wherein the optical cover comprises a lens portion corresponding to the optical semiconductor device.

13. The optical semiconductor lighting apparatus according to claim 1, wherein the heat dissipation base comprises male and female connectors placed on opposite sides thereof, respectfully, and at least one of the male and female connectors is connected to a female or male connector of another heat dissipation base adjacent the heat dissipation base.

14. The optical semiconductor lighting apparatus according to claim 2, wherein the heat dissipation base comprises male and female connectors placed on opposite sides thereof, respectively, and at least one of the male and female connectors is connected to a female or male connector of another heat dissipation base adjacent the heat dissipation base.

15. The optical semiconductor lighting apparatus according to claim 3, wherein the heat dissipation base comprises male and female connectors placed on opposite sides thereof, respectively, and at least one of the male and female connectors is connected to a female or male connector of another heat dissipation base adjacent the heat dissipation base.

16. The optical semiconductor lighting apparatus according to claim 4, wherein the heat dissipation base comprises male and female connectors placed on opposite sides thereof, respectively, and at least one of the male and female connectors is connected to a female or male connector of another heat dissipation base adjacent the heat dissipation base.

17. The optical semiconductor lighting apparatus according to claim 1, wherein the heat dissipation base has a width and a length, the air flow hole is longitudinally elongated at a middle of the heat dissipation base, the heat dissipation base is provided on an upper surface thereof with a pair of longitudinally elongated regions with the air flow hole interposed therebetween, and a circuit board including a plurality of optical semiconductor devices is mounted on the longitudinally elongated regions.

18. The optical semiconductor lighting apparatus according to claim 2, wherein the heat dissipation base has a width and a length, the air flow hole is longitudinally elongated at a middle of the heat dissipation base, the heat dissipation base is provided on an upper surface thereof with a pair of longitudinally elongated regions with the air flow hole interposed therebetween, and a circuit board including a plurality of optical semiconductor devices is mounted on the longitudinally elongated regions.

19. The optical semiconductor lighting apparatus according to claim 3, wherein the heat dissipation base has a width and a length, the air flow hole is longitudinally elongated at a middle of the heat dissipation base, the heat dissipation base is provided on an upper surface thereof with a pair of longitudinally elongated regions with the air flow hole interposed therebetween, and a circuit board including a plurality of optical semiconductor devices is mounted on the longitudinally elongated regions.

20. The optical semiconductor lighting apparatus according to claim 4, wherein the heat dissipation base has a width and a length, the air flow hole is longitudinally elongated at a middle of the heat dissipation base, the heat dissipation base is provided on an upper surface thereof with a pair of longitudinally elongated regions with the air flow hole interposed therebetween, and a circuit board including a plurality of optical semiconductor devices is mounted on the longitudinally elongated regions.

21. The optical semiconductor lighting apparatus according to claim 4, wherein the heat dissipation fins and the upward extending portions divide the air flow hole into a plurality of cell-type holes.

* * * * *